US008978302B2

(12) United States Patent
Oña González et al.

(10) Patent No.: US 8,978,302 B2
(45) Date of Patent: Mar. 17, 2015

(54) WINDBREAK SYSTEM

(75) Inventors: Francisco Oña González, Málaga (ES); Jorge Luis Pérez Falcón, Málaga (ES)

(73) Assignee: Allglass Confort Systems S.L., Malaga (ES)

( * ) Notice: Subject to any disclaimer, the term of this patent is extended or adjusted under 35 U.S.C. 154(b) by 0 days.

(21) Appl. No.: 13/321,433

(22) PCT Filed: Apr. 28, 2010

(86) PCT No.: PCT/ES2010/000187

§ 371 (c)(1),
(2), (4) Date: Nov. 18, 2011

(87) PCT Pub. No.: WO2010/136615

PCT Pub. Date: Feb. 12, 2010

(65) Prior Publication Data

US 2012/0061033 A1 Mar. 15, 2012

(30) Foreign Application Priority Data

May 25, 2009 (ES) ..... 200901275

(51) Int. Cl.

| | |
|---|---|
| ***E05D 15/26*** | (2006.01) |
| ***E05D 15/06*** | (2006.01) |
| ***E05D 15/58*** | (2006.01) |
| ***E06B 3/50*** | (2006.01) |

(52) U.S. Cl.

CPC ..... *E05D 15/26* (2013.01); *E05D 15/0608* (2013.01); *E05D 15/0682* (2013.01); *E05D 15/58* (2013.01); *E05D 2015/588* (2013.01); *E05Y 2900/15* (2013.01); *E06B 3/5054* (2013.01)

USPC ..... 49/125

(58) Field of Classification Search

USPC ..... 49/125, 127, 128, 129, 130, 436, 428

See application file for complete search history.

(56) References Cited

U.S. PATENT DOCUMENTS

| | | | | |
|---|---|---|---|---|
| 5,272,839 | A | 12/1993 | Karhu | |
| 5,548,926 | A * | 8/1996 | Sjoholm | 49/127 |
| 5,749,172 | A | 5/1998 | Isopahkala | |
| 6,301,833 | B1 * | 10/2001 | Airikkala | 49/409 |
| 6,397,522 | B1 * | 6/2002 | Nussbaum | 49/127 |
| 6,553,715 | B1 * | 4/2003 | Lonnberg | 49/127 |

(Continued)

FOREIGN PATENT DOCUMENTS

| | | | |
|---|---|---|---|
| BE | 553608 | A | 1/1957 |
| DE | 10333612 | A1 | 2/2005 |

(Continued)

OTHER PUBLICATIONS

International Search Report dated Sep. 7, 2010 in corresponding International Patent Application No. PCT/ES2010/000187, 4 pages.

*Primary Examiner* — Blair M. Johnson

(74) *Attorney, Agent, or Firm* — Hoglund & Pamias, PSC; Roberto J. Rios

(57) ABSTRACT

The invention relates to a windbreak system formed by a set of independent, folding panels that move longitudinally along an upper guide rail and another, lower guide rail and a non-movable folding door, in which each panel and the door include a rotating shaft and folding shaft. The panels are moved manually and do not have rollers, the entire weight of the panels resting on two strips of self-lubricating polymer inserted into slots in the lower rail.

14 Claims, 19 Drawing Sheets

(56) References Cited

U.S. PATENT DOCUMENTS

| | | | | |
|---|---|---|---|---|
| 7,260,916 | B2 * | 8/2007 | Sarnell et al. | 49/409 |
| 2012/0061033 | A1 * | 3/2012 | Ona Gonzalez et al. | 160/205 |

FOREIGN PATENT DOCUMENTS

| | | | |
|---|---|---|---|
| EP | 1795682 | A2 | 6/2007 |
| EP | 1889966 | A1 | 2/2008 |
| ES | 2324273 | A1 | 8/2009 |
| FI | 891666 | A | 8/1990 |
| FI | 924654 | A | 4/1994 |
| FI | 955693 | A | 11/1997 |
| SE | 9902369 | A | 4/2000 |
| SE | 9804540 | A | 6/2000 |
| WO | 0104446 | A1 | 1/2001 |
| WO | 2004022897 | A1 | 3/2004 |

* cited by examiner

WINDBREAK SYSTEM

RELATED APPLICATIONS

This application is the U.S. national stage application which claims priority under 35 U.S.C. §371 to International Patent Application No.: PCT/ES2010/000187 filed on Apr. 28, 2010, which claims priority under 35 U.S.C. §119 to Spanish Patent Application No. P200901275 filed May 25, 2009, the disclosures of which are incorporated by reference herein their entireties.

FIELD OF THE INVENTION

The present invention is a system made of aluminum, glass and steel made of independent panes that allow the delimitation, enclosurements, or isolation of spaces, either in houses (balconies, patios, porches . . . ) or in businesses (restaurants, offices . . . ).

This invention can be included into the technical sector of building systems or materials.

STATE OF THE ART

At present there are different enclosurements systems in the world based on independent panes made of glass and aluminum, as described in patents SE9902369, FI924654, SE9804540, FI955693 and FI89I666. All these systems are based in the use of bearings and wheels and are designed being the weight top hang. Top bearings hold the weight of the system and the bottom ones guide the sliding panes along the bottom track.

These kind of systems using bearings and top hanging are under a continuous stress due to the force of gravity and it is a matter of time they start to show problems and a maintenance is required, such as: panes get stuck, the panes are not well adjusted and don't match perfectly, etc. Also the weight being on top constrains the commercialization possibilities of these systems because the ceiling can't be strong enough to hold that weight without being reinforced, also the fitting process will require an additional effort designing an additional structural ad-hoc solution for every situation.

The invention described in this patent solves these problems cause by the use of bearings and having the weight top hang. The solution doesn't make use of bearings or wheels and the weight of the system is on the bottom instead on the top.

The invention also has a system of sliding tracks designed in such a way that the system becomes waterproof against any possible water leakage, something very common in these systems as the moving panes have joints in between the panes that are not 100% waterproof and, else more, have a progressive aging as they are exposed to the direct sun and other inclement weather conditions.

This invention, unlike other state of the art known systems, allows some certain margin of error in the fabrication of the glasses provided by the suppliers as it has adjustable bottom profiles that overcome the possible imperfections on the glass, such as not perfect rectangular shapes, over or under measurements comparing to the exact measurements of each panel, etc.

Unlike other systems, the turning and guidance mechanisms of the panes are not fabricated following a model of screwing the parts to a plate and then welding them. On the contrary, the screwing process has been replaced for a fixation by pressure of one part into the other and then welding them together. This way the fitting of the components into the plates can be done in a unique way, this helps the installation process and the future safety of the everyday use of the system.

SUMMARY OF THE INVENTION

The system described is made of a set of independent panes that can be operated manually sliding them along the top and bottom track. The bottom track supports the weight of the panes that slide on it, without any kind of bearings or wheels.

There are two kinds of panes, a fix one called door and the rest are all the same and slide over the bottom track. It is named door because it works exactly as a normal door, i.e. it has an axis to turn around so the system can be open or close. Like normal doors, it has a locking part to open or lock the whole system. The pane called door it is always placed in one of the track ends; the rest of the panes will have to be moved to the door position to be folded. All the panes will be folded in parallel to the door open mode, i.e. orthogonally to the bottom and top tracks direction. All the independent panes are made of glass, tempered or laminated, with a thickness within a range of 6 to 20 mm. The panes slide over the tracks by means of two sliding strips and all the weight rests on the bottom track. The top track works as a guide for the panes, not supporting any weight. All the panes work independently and a person can slide them along the tracks. The panes only have two possible positions or modes. The first one is the folded position, perpendicular to the direction of the tracks, and the second one is the deployed position over the tracks, following the same direction of them, when they are not folded. All the panes can be folded only at the door position. If they are not folded they can be placed at any position along the tracks, offering a great flexibility in the configuration of the panes depending in weather conditions (wind, heat, cold . . . ). For example, a pane can be followed by an empty space of the same size as a panel, followed by another pane and so on. Obviously, to achieve this configuration half of the panes must be folded at one end of the track.

The glass is always glued to a top and bottom aluminum profile; there are no fixing screws in between glass and profile.

The top part of the profile includes two arms, each of them having two tiny prominences in the inner face and a base where the glass fits on. Two side arms extend down, from the base of the profile, resulting in a trapezoidal shape that is opened on the bigger side. Inside the trapezoid there is a flat steel plate that joins the pane profile to the top axis part. This part goes into the top track by means of a stainless steel T axis-guide and a piece called top guide bushing, made of polyamide or similar material, and allows the longitudinal sliding movement over the top track.

The bottom part of the profile includes two arms and a base. Each arm has two tiny prominences in the inner face and a base where the glass fits on. There are two more arms extend from the base of the profile. This profile has an H shape. This profile is assembled into another profile, the sliding profile, by means of bolts. These bolts allow a regulation in height of the H shape inside the sliding profile to correct any mismatch in the glass measurements because it is usual the glass supplier can not supply glasses with a precision better than 2 mm. This sliding profile has two upper arms to hold the H shape profile, where the glass is glued.

Because the sliding profile contains the H profile where the glass is glued, it makes invisible any possible internal adjustment to correct any mismatch in the glass measurements. Otherwise, the profiles in the joints sections of two panes wouldn't be aligned and the visual effect would be quite poor.

From the bottom of this profile extend down two lower arms, resulting in a trapezoidal shape that is opened on the bigger side. Inside the trapezoid there is a flat steel plate that joins the pane profile to the top axis part. This part goes into the bottom track by means of a stainless steel T axis-guide and a piece called bottom guide bushing, made of polyamide or similar material, and allows the longitudinal sliding movement along the bottom track.

The bottom guide bushing is made of one piece with five different steps or layers of different sizes:

An oval base with two straight long sides.

A cylinder with a bigger diameter that is in contact with the internal sides of the bottom track.

Another cylinder that acts as a step between the upper and lower cylinders.

A cylinder with a smaller diameter that is in contact with the internal sides of the bottom track. This cylinder fits into the upper opening of the bottom track.

Finally, on top of the smaller diameter cylinder there is a fourth cylinder with a diameter slightly bigger than the opening of the bottom track. This is this way to avoid the bottom guide to drop inside the bottom track.

The bottom track has a rectangular shape with the base closed. The upper part is partially opened. The opening in the bottom track has two equidistant internal sides in the inner area but not for the outer ones that partially close it. In the upper sides that partially close the opening there are two equidistant channels, with a depth of 4 mm, equidistant to the longitudinal axis of the track, where the sliding strips, made of a mixture of self-lubricating polymers, fit perfectly. The weight of every pane rests on these two strips. These two channels have a perpendicular 7 mm width channel to accommodate brushes. There is a third channel designed to collect any possible water leakage from the outside, making it waterproof. This channel has holes, every certain length, along the track to collect the water from the channel and let it flow to the interior of the bottom track, and from there, to the exterior through the evacuating holes in the outer face of the track, The bottom track is fixed to the floor using self-tapping screws.

Inside the trapezoid there is a steel plate crossed by the bottom axis-guide. This steel plate also works as a fixation for the bottom guide bushing that is placed inside the bottom track. These parts allow a fine adjustment of the profile to the bottom track in order to achieve an optimal assembly between the profile and the self-lubricating strips, made of a mixture of polymers, where the weight of the pane rests, allowing an optimal sliding operation of it.

The top edge of the glass is glued to an aluminum H profile, in particular, to two arms of this profile and the base of this profile has a trapezoidal shape, and with the upper part opened, being this the bigger side of the trapezoid. The base is the smaller side that holds two arms. Inside the trapezoid there is a set of parts that is called the upper part of the top axis. These parts are:

Top bushing guide: it is made of plastic with a circular shape and is placed inside the top track. This bushing guide is made of polyamicle or similar materials and it has two cylindrical steps or layers with different diameters. The lower cylinder has the bigger diameter and is in contact with the inner sides of the top track. The upper cylinder has a smaller diameter. The bushing guide has a circular hole inside to let the T axis-guide go through it, being the diameter of the circular hole smaller than the smaller one of the head in the T axis-guide A T axis-guide made of stainless steel, having the head of this pant an oval shape with two straight long sides.

A stainless steel clip to position the top bushing guide in the right position at a certain height of the T axis-guide.

The head of the axis-guide fits into the turning mechanism. The base of this T axis-guide crosses the open side of the trapezoid shape of the top profile, profile that holds the glass in the opposite hole, and joins to the steel plate placed inside the trapezoid hole of this profile. This steel plate has two holes of identical diameter and another one with a semicircular shape, placed along the longitudinal axis of this part. The steel plate has a rectangular shape with three straight sides and one small side in a rounded shape. The T axis-guide fits in the semicircular shape hole that is closer to the rounded shape side, which is closer to the edge of the pane or door. This steel plate is positioned over the trapezoidal profile area with the help of two endless screws, screwed into the circular holes with identical diameters, until they press the edges of the open side of the trapezoid and fix the plate to the profile. The purpose of this steel plate is keeping the profile close to the top track with the help of the components of the T axis-guide part. These parts are not designed to stand the weight of the panes, as it rests on the bottom of the system.

The top track is identical to the bottom track. There are two small channels with a depth of 4 mm, and inside those channels a perpendicular notch with a length of 7 mm for the brush, placed at an equidistant position from the longitudinal axis of the track. The additional channel is designed to collect any water leakage in the bottom track and can be used as a fixing notch for embellishing plates in the top track.

The pane called door, is placed at one of the track ends, has a different configuration from the rest of panes, it works as a real door instead of a sliding pane. The top edge of the glass is glued to an aluminum profile, in particular to two arms of this profile. The base of this profile has a trapezoidal shape, with the upper pan opened, being this the biggest side of the trapezoid. The base is the smaller side and holds two arms. Inside the trapezoid there is a steel plate that is crossed by an endless screw, the screw head fits inside the top pivot. The top pivot is made of polyamide or similar material with a cubic shape with a hole placed in its centre. This hole has a smaller diameter than the head of the screw that crosses the base of the top track and is screwed to a nut placed on the ceiling to fix it. Another screw comes out the bottom hole, whose circular section has a bigger diameter than the head of the screws, allowing the screw heads to fit inside this part. The bottom part of the door has the same elements between the bottom profile, having a trapezoidal shape, and the bottom track.

These bottom and top guides allow the rotation of the door in both directions. With the help of an endless screw the door can be adjusted to the top track. This axis parts are not designed to stand the weight of the door, that task is done by the bottom track.

There is the possibility of having another door in the system that is not placed at the tracks ends, this door is named sliding door. The configuration of the sliding door is similar to the normal panes, the only difference is that the bottom bushing guide has a cylindrical base instead of an oval one with two straight long sides. Inside the bottom track there is a tramp piece, it has a rectangular form with an open circular shape side to trap the bottom-bushing guide of the sliding door and allow the pivoting of this sliding door.

The door, fix or sliding, and all the panes, have in the upper part of the profile, at the opposite side to the pivoting axis, a mechanism, called top guide, made of a bolt that goes through a hollow cylinder made of polyamide. The head of this bolt is bigger than that the diameter of the cylinder in such a way that when is completely screwed in the steel plate, the head is inside the cylinder but like a cap of it. That steel plate is fixed inside the trapezoid of the profile using an endless screw. This steel plate, made of stainless steel, has consequently two threaded holes.

In the bottom track, the bottom sides of the profile trapezoid are in contact with the strips, made of a mixture of polymers, accommodated inside the bottom track channels. Inside that trapezoid is placed a washer with an H shape, it is partially described in between the sides of the open side of the trapezoid hole of the bottom profile, in such a way that the bottom of the H shape washer matches the open side of the bottom track. The washer doesn't rest on the sliding strips made of a mixture of self-lubricating polymers. With the help of a screw that crosses the threaded hole through the longitudinal axis of the H washer and reaches the trapezoid base, this H washer has to be positioned along the bottom profile to pass through the notch made in one of the polymer strips when the panes are folded.

At any of the end of both tracks, where the door is placed, there is a mechanism fitted inside the track. This mechanism has a row of spoon-shaped areas or semicircular shapes. In every spoon-shaped area hole fits the head of the T axis-guide that is placed in the corner of the top profile in every pane. At this hole will be the point where the turning axis will be operating for every pane while folding.

The top track has a rectangular hole on the interior side from where the panes will be folded, attached to this hole there is a metal piece called guide-arm that will allow the panes to be folded. This hole on the top track allows the pane to pivot and be folded close to the door. The semicircular holes or spoon-areas not only allow the turning movement of the panes but also keep then blocked to avoid up and down movements in the panes when they are in the folded position.

The pivoting of the panes is achieved by making the head of every T axis-guide fit into every turning mechanism spoon-shaped area placed at the end of the tracks, by the door pivot axis. The spoon-shaped area allocates and assures the exact point of the pivot axis for every pane. Else more, the little tolerance in the matching of the spoon-shaped area and the head of the T axis-guide, allows a little unbalance pivot movement that helps the opening process of the panes. When a pane folds back, it turns around at the pivot axis that is enabled by the former parts as described before and at the same time the H washer passes through the notch done in one of the sliding strips made of a mixture of polymers in the bottom track. On the top side, the top guide can only get out of the top track through the square hole where the guide-arm is placed.

The door has a rod that operates in conjunction with the bottom lock to open and lock the door and consequently the whole system. The rod is fixed to the guide-arm. This locking system is placed in the indoor side of the system, by doing so the system cannot be opened from the outside.

The sliding movement of the panes can be done manually and has to be done individually. The sliding and folding movement of the panes will allow an easy cleaning process of both glass faces. The panes can reach a height of 3.5 meters and be operated manually by a person.

The sliding strips are made of a homogeneous mixture of polymers. This material has optimal properties that allow the aluminum slide easily over it with a minimal effort by the person operating the system. The usage and the years won't spoil these strips because they are very tough and friction-resistant. The wearing-out of this material is almost zero, the same happens with its maintenance. Alternate Embodiment.

1. The present invention may also be comprised of the following alternate embodiment:

An alternate top profile which has a flat base and side arms, with small protuberances up to 0.5 mm long on their inner faces, to improve the union between the glass and the aluminum profile. Both arms have a cavity on the top area to collect the excess of glue which could leak out of the profile during the gluing process. The terminations of these arms have two flat sides to hide the view of the bonding material that fixes the glass and aluminum from the outside. The bottom area of the profile has an inverted "U" shape hole to insert and fix the top turning set and top guide set of this alternate embodiment.

2. An alternate bottom profile which also has a flat base and side arms with protuberances, teeth like, of a size up to 0.5 mm, on their interior face to improve the bonding between the glass and the aluminum profile. The bottom area of the profile has an inverted "U" shape hole to insert bolts that fix this profile to the bottom sliding profile base and allow a height regulation of this profile inside the other one to overcome the glass imperfections originated in the glass cutting process.

3. A different "U" shape leveling profile accommodates leveling sets, formed by an eccentric bolt and a flat head screw. The screw has a circular head with a diameter big enough to assure a stable support of the aluminum track, the height of the screw is design to level the track on uneven floor or ceiling surfaces. The eccentric bold has the precise dimensions to fit perfectly on the leveling profile base and avoid any undesired movement and also provide a stable support basement for the whole system. On top of the leveling sets is placed the bottom track. The arms of the leveling profile centre the track and hide the leveling sets and fixation screws. The leveling profile base has two corner holes to insert a cap to avoid indoor water leakage at the track ends.

4. A different top turning set has a metal body and a top guide bushing. The base of the metal body is a plate with three layers and a protuberance. First layer assures the right coupling in between the panes when they are being deployed. This layer has a reference mark to insert this set in the correct position in such a way that all the panes will have the sets fitted at the same distance in the top profile. On the second layer there are small, teeth like, protuberances up to 0.5 mm long, to fix tightly the set to the aluminum top profile. The width of the third layer assures a centered position of the set in relation to the pane, as it has the same width as the top profile opening. The protuberance has a wedge shape to support the set body and to assured a vertical position of the axis over the top aluminum profile, and removing a second screw present in the former version. The top guide bushing has a circular shape and two layers. It is made in one piece of polyamide or similar material. This bushing is inserted by pressure into the rounded metal head of the top turning axis. The outer diameter in the bushing assures the centered position of the pane in relation to the track and avoids noises when the panes are sliding.

5. A bottom turning set has a metal part with two bodies and a bottom guide bushing. The metal part is form by two bodies assembled by an arrow locking joint, also known as click, that allows a part to enter into the other one but not to exit from the other one, it creates a rigid union that can't be disassembled.

The base of the metal body is a plate with three layers and a protuberance. First layer assures the right coupling in between the panes when they are being deployed. This layer has a reference mark to insert this set in the correct position in such a way that all the panes will have the sets fitted at the same distance. On the second layer there are small, teeth like, protuberances up to 0.5 mm long, to fix totally the set to the aluminum bottom sliding profile. The width of the second layer assures a centered position of the set in relation to the bottom sliding profile, as it has the same width as the profile opening. The protuberance has a wedge shape to support the set body and to assured a vertical position of the axis in relation to the bottom aluminum sliding profile, and removing a second screw present in the former version of this set.

The bottom guide bushing has a "T" shape, side faces are flat and the front and rear ones are rounded. The bushing width is smaller than the aluminum track opening, therefore the panes can be mounted and dismounted without the need of a hole in the track. The bottom guide bushing is centered in relation to the set axis, but is not fixed, making possible to keep the parallelism between the fiat sides of the bushing and the aluminum track.

The bottom guide set solves a problematic situation present in the former version, as during the installation process it was necessary to insert a metal pin inside the plastic bushing, a delicate process that sometimes broke the plastic bushing. Also this breaking could happen if the operation of the panes was not correct or an object could fall inside the track and block the normal operation of the bushings. This breakage involved dismounting the whole system, as the former bushing can't be introduced into the track from the top, it has to be done from one side of the track. So, there is no need to design a specific hole in the track as the new version allows the top-down insertion into the track. Therefore, the bushing width allows the panes to be mounted and dismounted without the need of a hole in the track to insert these new sets inside.

6. A new top guide set has a metal body and a top guide bushing. The base of the metal body is a plate with two layers, an axis, and a protuberance. On the first layer there are small, teeth like, protuberances up to 0.5 mm long, to fix tightly the set to the aluminum top profile. This layer has a downward slope at its front end to ease the movement of the set along the top profile longitudinal hole. The width of the second layer assures a centered position of the set in relation to the top profile, as it has the same width as the profile opening. The protuberance has a wedge shape to support the set body and to assured a vertical position of the axis over the top aluminum profile, and removing a second screw present in the former version. The top guide bushing has a circular shape and two layers. It is one piece made of polyamide or similar material. This bushing is inserted by pressure into the cylindrical metal head. The outer diameter in the bushing assures the centered position of the pane in relation to the track and avoids noises when the panes are sliding.

7. A cap is placed at both ends of the bottom track. The shape is the same as the track hole, so it can fit in perfectly. The bottom track outside face has small draining holes, therefore in case of water leakage from the panes joints sections, it can flow outdoors.

8. An alternate top locking block. The block has a base with a protuberance aim to position it perpendicularly to the top aluminum profile, avoiding any possible movement of this block. In the front side there is another protuberance working as a stopper against the interior side of the top aluminum profile, positioning the door in relation to the top aluminum track. This way, the door is in line with the rest of the panes. Both protuberances position the block in relation to the top aluminum profile and the top track, avoiding accidental marks or scratches during the installation on the outer faces of these profiles.

9. An alternate pivot block and a turning mechanism set substitute former turning mechanism. This set is formed by a pivot block and a turning mechanism that are assembled, giving as a result, one body. This pivot block replaces the former pivot cubes, made of polyamide, on top and bottom, from the first patent request. The pivot block has a rectangular shape in all its sides, and a hole that is slightly not centered as the top and bottom axes must have a shift between them for the correct operation of the system. There are two sides with a protuberance and a hole each, on their bottom. These shapes, identical to all the pieces, are used to assemble the components in the turning mechanism of the alternate embodiment. The turning mechanism has plates with two spoon-shaped areas, or half moons, each, all these plates have identical protuberances for the assembly between them and to the pivot block.

This turning mechanism and pivot block set can be used on top and bottom of the windbreak system, and in any other possible opening configuration, without any mechanical operation in the components. To achieve this, the pivot block on the bottom must be assembled to the spoon-shaped areas plate using a different protuberance than the one used in the top pivot block, as the axis hole position is not symmetric in the longitudinal axis defined by the longest sides of the block. This way, the installation process is easier and more reliable than the one described in the former patent request.

10. A two-part adjustable corner plate. This corner plate can couple different sections, it can happen when there is an angle and two tracks must be connected. Moreover, the two-part adjustable corner plate assures that both sections won't move once they are assembled during the operation of the system. The two-part adjustable corner plate has two identical plates connected by a joint section in their rounded shape sides. These semicircular ends have a step so they can couple by means of the joint section. This step is delimited by two straight edges forming an interior angle of 270°, this way, the set can be used to connect sections with an angle within a range of 45° to 315°. The other small side is straight. Along the central axis of the plates there is an oval hole, whose longer axis is parallel to the longer sides of the plate, and a circular hole, being the oval ones closer to the small straight side of the plate. The oval hole is always used before the other one, as it allows a regulation on the connection process of the tracks. The second hole is used for the final fixing, once the tracks are connected properly.

11. A different top turning set eliminates the need of using the guide-arm when folding the panes. This set is formed by a metal axis element and a blocking bushing. The metal axis element has a cylindrical shape. The bottom area of the axis has a semicircular shape to be inserted in a fixing plate. Around the middle of the axis there are two wings connected, with an element having the shape of a ramp. This ramp will allow the blocking bushing to go up the axis until it reaches the pivot position at the top turning mechanism height. At the top of the axis there is a head with a small ramp that will press the blocking bushing down the axis when the pane is going to be deployed, so it can leave the top turning mechanism. The front side of the head has a rounded shape and will block the pane when folded, as the axis rotates approximately 90° in relation to the blocking bushing. The blocking bushing has two layers. The first one, the one with the bigger diameter, has a ramp that will elevate the bushing, when meeting the axis ramp, up to the top turning mechanism height. The second layer is symmetric to the central vertical axis and has an interior ramp in the inner hole and two rounded sides to block the metal axis element head when it starts the rotation movement. When the pane is going to be deployed the central ramp in the blocking bushing will slide downward over the axis head ramp and will down the blocking bushing, therefore leaving the top turning mechanism.

12. A bottom guide, having a metal plate and a washer, made of polyamide or similar material, replaces the former one. The base of the metal body is a plate with two layers. On the first layer there are small, teeth like, protuberances up to 0.5 mm high, to fix totally the set to the aluminum bottom profile. The opposite side of the first layer base has a channel with a width equal to the width of the opening of the aluminum bottom profile, so they are both in line. The height of the second layer is the same as the thickness of the base of the bottom profile, so when this plate is fixed, this layer will be at the same level as the base of the bottom profile, making the base, at this point, a flat continuous surface. The plate is made in one piece by injection to assure that all the dimensions and symmetries are correct. This way, the set will work properly and will eliminate the minor differences in measurements among the plates in different production batches.

The washer, made of polyamide, has a round shape and a hole along its vertical axis, having two layers with different diameters. The bigger diameter layer is designed to keep the pane in line with the aluminum bottom track. The washer head has a smaller diameter than the former and is used to couple with the metal body, by an arrow locking or click system, and keep them together. Nevertheless, the washer can rotate freely as its cylindrical interior hole matches a cylindrical pin based on the first layer of the metal body and with a height equal to the second layer. This bottom guide set eliminates the need of making a notch in one of the two sliding strips inserted in the bottom track, making this support area completely flat and continuous. This way the base of the bottom profile won't hit or get stuck in the sliding strips during the pivoting movement, making the operation of the system smoother. Another improvement is that the possibility of damaging the strips, while folding the panes, is removed.

13. A wedge has three layers with a rounded side. First layer is a base placed underneath the two-part adjustable corner plate. It has that rounded side to allow the plates to move while connecting two tracks, and at the same time, keep the wedge at a fix position when the panes pass along the corner. The second layer connects the first and third one and fills the gap in between the corner and the rounded plates when connecting two sections with angles. The third layer has a rounded shape to avoid the bottom turning bushing to get stuck in the corner and pass along the tracks smoothly from one section to another.

The following parts are made in one piece by injection to assure the right measurements for a perfect coupling among them and eliminate possible flaws in the fabrication batches:

Top turning set metal body

Two metal bodies in the bottom turning set of the alternate embodiment.

Caps for the track end.

Locking block of the alternate embodiment.

Pivot block and turning mechanism.

Two-part adjustable corner plate.

Metal axis element and blocking bushing in the new top turning set that eliminates the need of the guide-arm.

Plate in the new bottom guide

Wedges, making easier the coupling of this part with the two-part adjustable corner plate.

The material used for these metal bodies can be aluminum, stainless steel or other metallic alloy.

EMBODIMENT EXPLANATION

Figure 1:
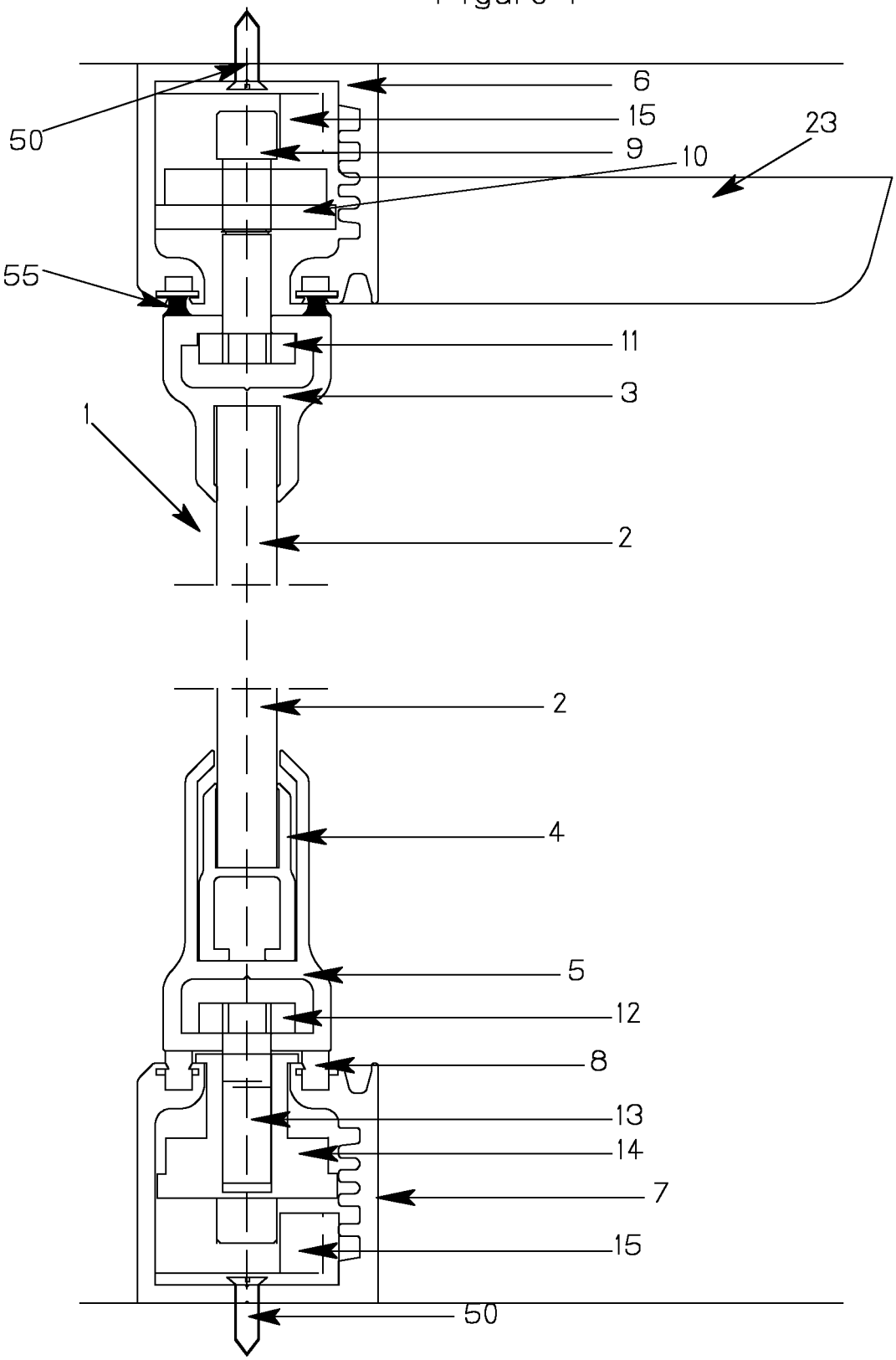
FIG. 1: Sliding pane cross-section at the pivot axis.

FIG. 1 shows a pane or panel (1) made of glass (2), whose thickness is within a range of 6 to 20 mm. Thicker glass than 20 millimeters would be hardly stand by the structure described in this patent, while a thickness smaller than 6 millimeters implies a reduced isolation, thermal and acoustic performance, as well as poor safety against impacts. The top edge of the glass (2) is fixed by gluing it to a top profile (3) with a trapezoidal H shape and to a bottom profile (4) with a trapezoidal H shape and partially trapezoidal base, contained inside a sliding bottom profile (5) with an H shape with a partially trapezoidal base.

Figure 18:
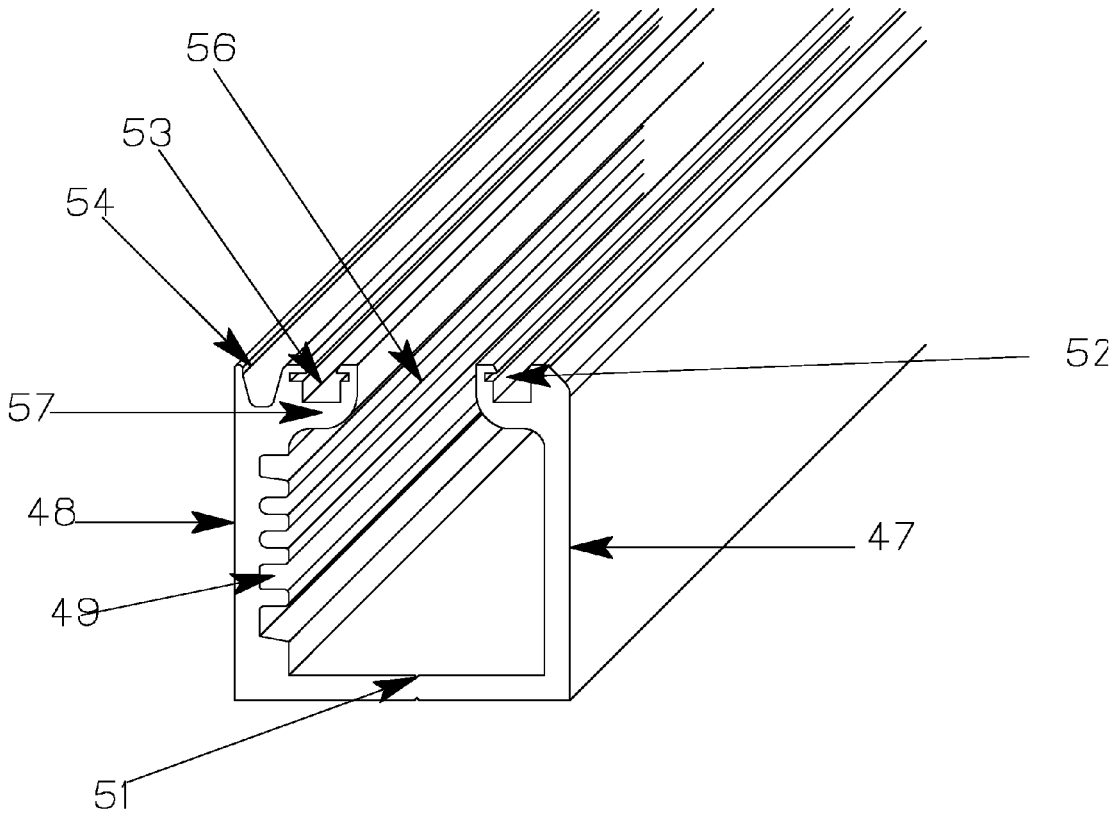
FIG. 18: Top and bottom track side elevation

There are two possible pane (1) movements. A longitudinal one sliding over the strips made of a homogeneous mixture of polymer (8) fitted into two channels (52, 53) in the bottom track, FIG. 18. These two channels (52, 53) are present at the top track (6) and bottom track (7) and they are equidistant from the longitudinal axis of the tracks (6,7). The second pane movement is the turning one by the used of parts allocated in the top track (6) and bottom track (7). In the top of the pane there is a turning part called top turning set formed by a T axis-guide (9), a bushing guide (10) and a steel plate (11). In the bottom of the pane there is a bottom turning set made of a steel plate (12), an "axis-guide (13) and a guide bushing (14). Steel plates (11,12) are fixed in the top profile (3) hole (39) and in the bottom profile (5) hole (45) of each pane (1) by means of a pair of endless screws, not shown in the figure, screwed across the steel plates and the profiles (3,5). By doing so, the top and bottom turning sets are placed at a certain position into each profile (3, 5).

Figure 13:
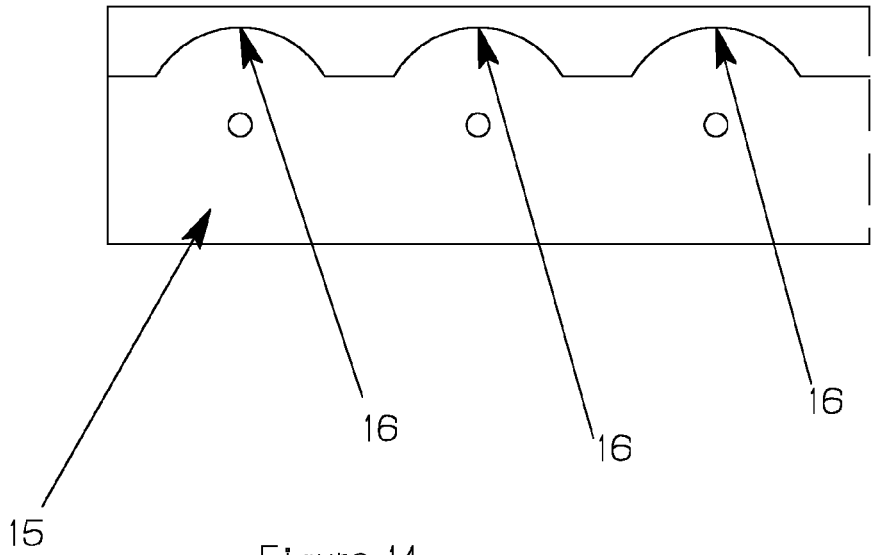
FIGS. 13 and 14: Turning mechanism cross section and top plan.
Figure 14:
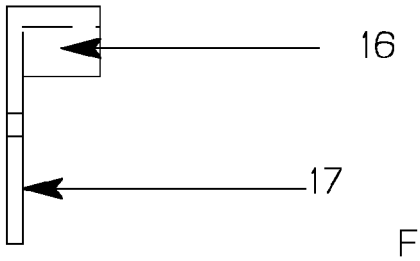

The top turning set (9, 10, 11) pivots on the turning mechanism (15), which is always fitted inside the top track (6) and bottom track (7) nearby the door (24) pivot axis. As shown in FIGS. 13 and 14, this mechanism (15) is a rectangular piece higher than the head of the T axis-guide (13). The flat face is in contact with the interior walls of the tracks (6, 7) being fixed to them by a set of screws. The closest part to the ceiling of the turning mechanism (15) has a set of corners and curves like a spoon-shaped area (16) with a height bigger than the head of the screw (34) or T axis-guide (9). These spoon-shaped areas or half moon shapes (16) receive the head (34) of the T axis-guide (9) of every pane (1) allowing the pivoting movement of the top turning set (9, 10, 11). Each pane (1) will have a unique position defined in each, of these spoon-shaped areas (16). The turning mechanism will have as many spoon-shaped areas or half moon shapes (16) as panes in the system (1). These spoon-shaped areas (16) have a 2 mm tolerance with the T axis-guide (9) to enable a smooth operation and without frictions in the metal to metal contact that could damage both parts in the long term. A similar solution is designed for bottom turning set (12, 13, 14). In this case, the turning mechanism spoon-shaped areas (16) receive the lower step of the bottom bushing (14).

Figure 2:
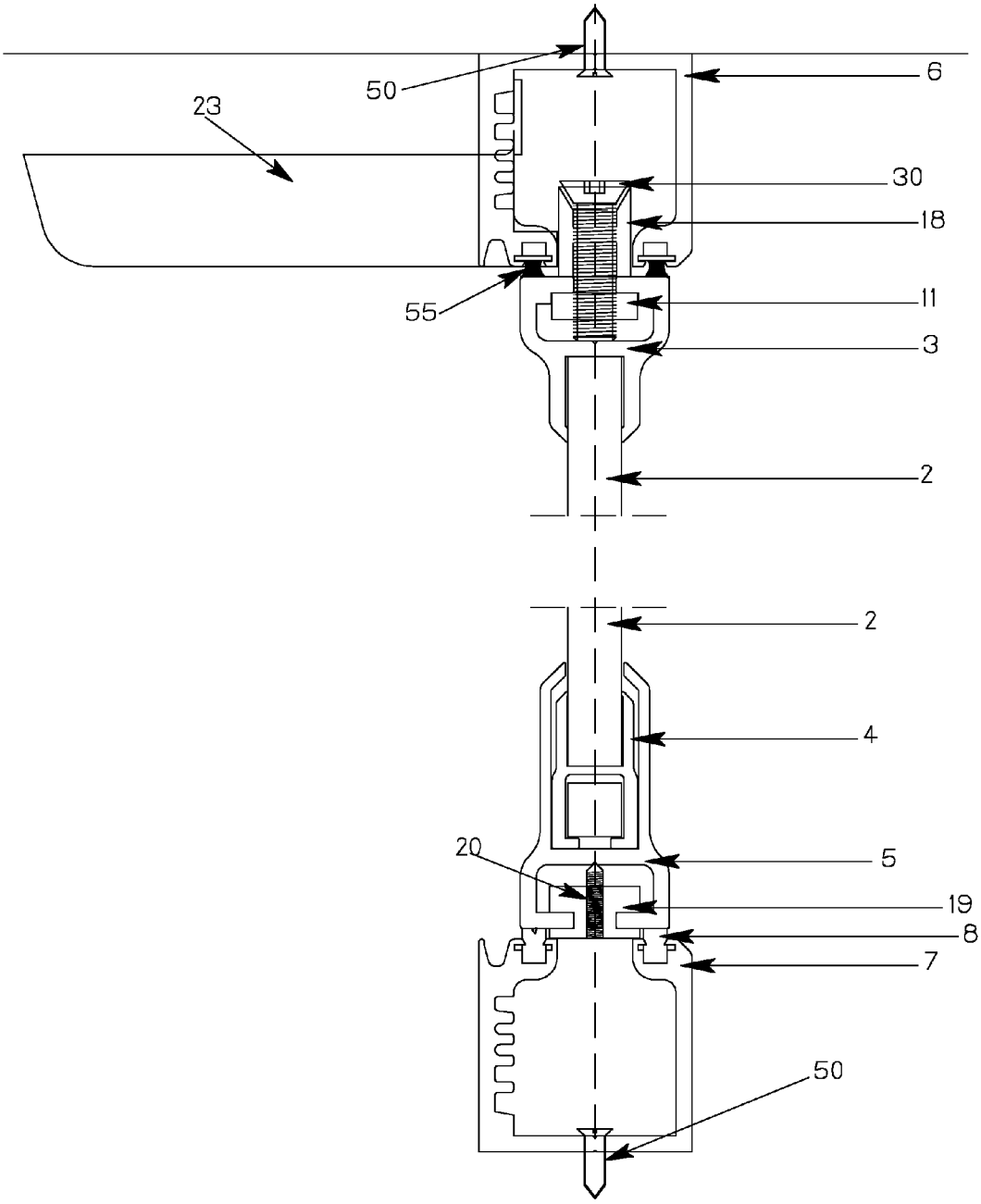
FIG. 2: Sliding pane cross-section at the pivot axis, opposite view.
Figure 3:
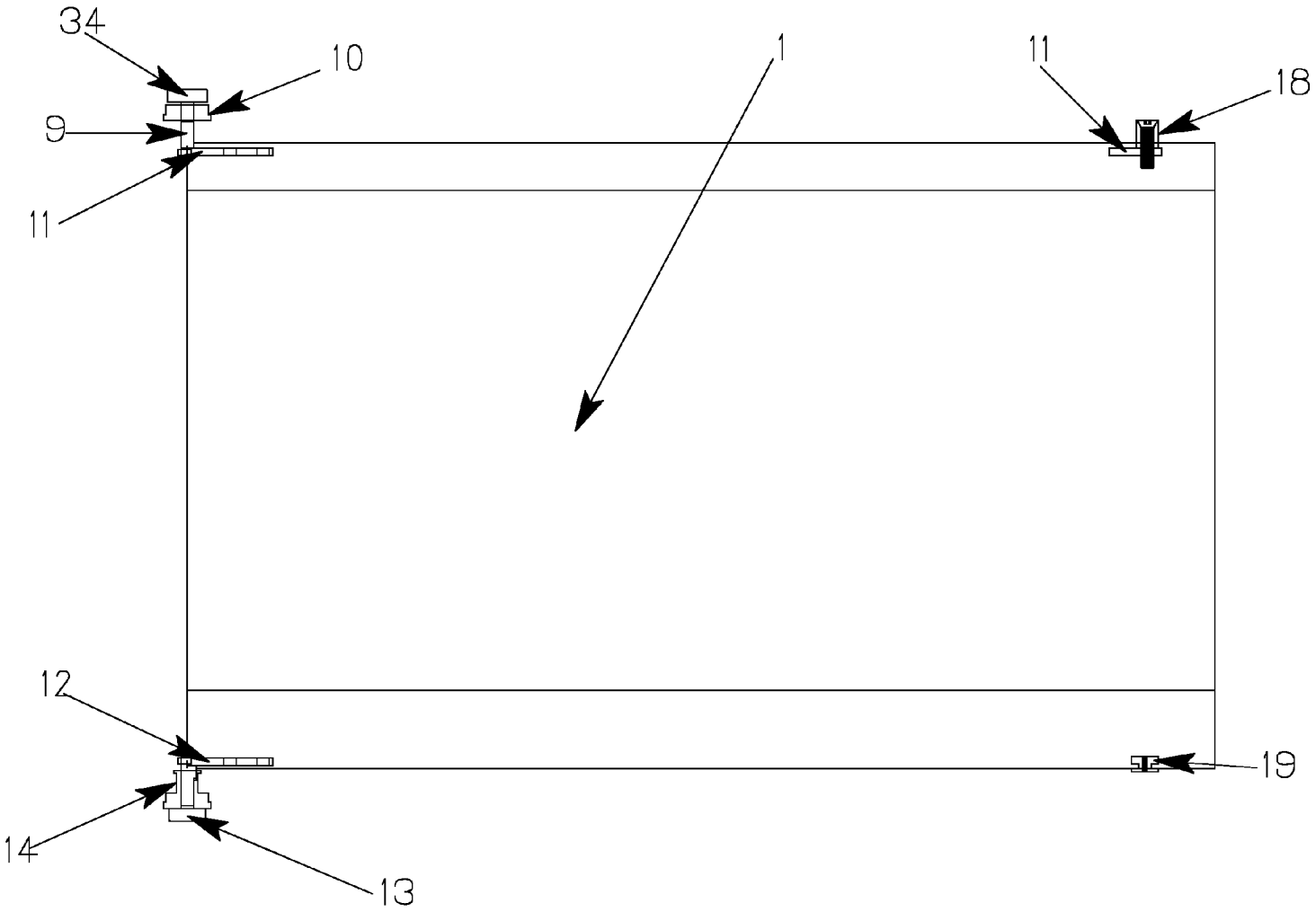
FIG. 3: Sliding pane side view.

A top and bottom guide set, as shown in FIG. 2, is used to place every pane (1) in the right exit position from tracks, that exit position will define the point of the pivot axis. So, the top turning set (9, 10, 11) and bottom one (12, 13, 14) explained in FIG. 1 work together with the top guide set (30, 18, 11) and the bottom guide washer (19) placed at the opposite side of the pane. The top guide set has these components: a screw (30), crossing a hollow bushing (18) protecting it, it fits into a screw hole in the steel plate (11). The steel plate (11) is fixed to the top profile (6) by means of two endless and headless screws that fit into the inside hole of the top profile (6). When a pane (1) turns around, one side exits from the bottom (7) and top track (6) at a point defined by a hole made in the top track (6). At this hole is placed, using screws, a part to help the pivot movement called guide-arm (23), fitted in a perpendicular direction to the top track (6). The guide-arm (23) works as a lever to pivot the pane (1) in combination with the top guide set (11, 18, 30). The top guide set (11, 18, 30) can be placed in different positions at the top profile (6) of each pane (1) making possible that each pane (1) opens at a precise distance that position the top turning set (9, 10, 11) into its spoon-shaped area (16), which is part of the turning mechanism (15). The bottom guide is a cylindrical washer with an H shape (19) placed at a certain position inside the bottom sliding profile hole (45) by means of an endless screw. The H washer (19) is made of a plastic element with a double circumference joint by an axis; the top circumference is placed inside the hole of the sliding profile (5) and the axis, with a smaller diameter, fills the gap of the bottom sliding profile (5). The bottom circumference of the H washer (19) doesn't rest on the bottom track (7) as the weight of the panes (1) rest on the inner sides (47) of the bottom profile (5) and therefore on the strips (8). The H washer (19) leaves the bottom track (7) always at the same point. To achieve this, a small notch is done in one of the polymer strip (8). As with the top guide set (18), the H washer (19) can be placed along the bottom profile hole (45) inside the sliding profile (5) by means of a small endless screw that crosses the axis of the H washer (19) and make possible to fix it at a certain position. So, the positions of the components that are part of the top and bottom guide set, i.e., the top guide screw (30), hollow bushing (18), steel plate (11) and cylindrical washer (19), are defined by the folding order in the turning mechanism of their panes (1). This can be seen clearly in the FIG. 3, where the elements that form the top turning set (9, 10, 11) and bottom turning set (12, 13, 14) are placed at the corner of the pane (1), while the elements that form the top guide set (11, 18, 30) and bottom guide (19) are positioned at the opposite corners, the final position is set depending on the folding order of every pane (1) and therefore the pane (1) leaves the top track (6) and bottom track (7) at this point.

Figure 19:
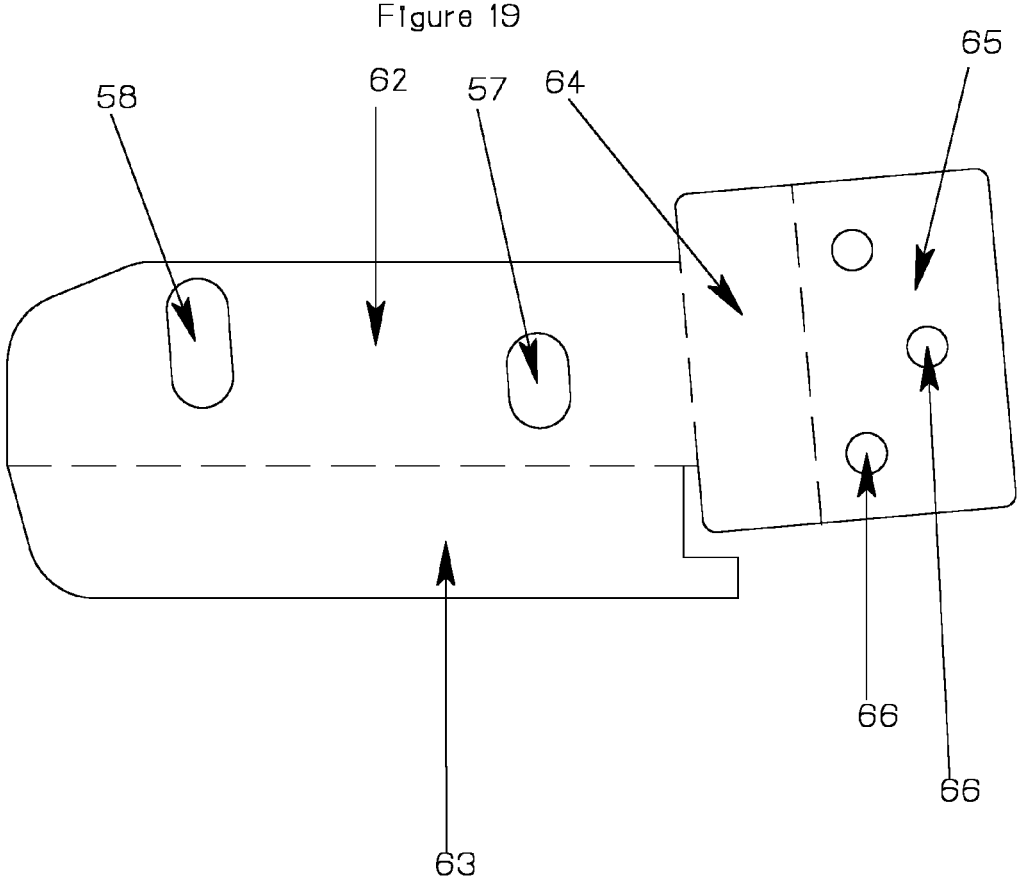
FIGS. 19 and 20: Guide-arm not folded top plan and folded side view.
Figure 20:
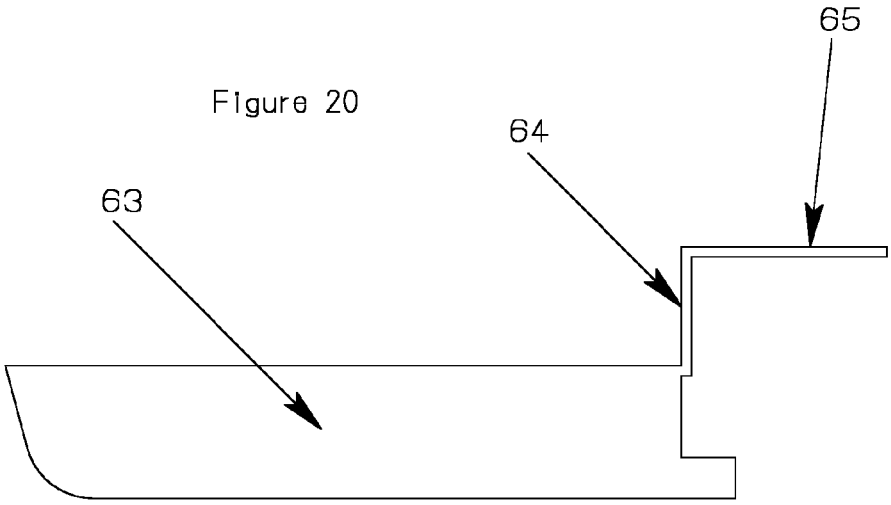

The guide-arm (23) helps the pivot movement of the panes (1) and is perpendicular to the axis defined by the top track (6) and bottom track (7). Else more, it holds the door (24) locking system pin (56). The guide-arm (23) is fitted in a hole done in the top track (6) and, close to the opposite edge of the door (24) pivot axis. The guide-arm (23) is made of stainless steel. As it is shown in the FIGS. 19 and 20, the guide-arm (23) has a flat side (62) parallel to the floor with two holes (57, 58) where a pin (56) can be inserted, the pin (56) is part of the door (24) locking system. This side (62) goes perpendicularly to the top track (6) sides and to the other side (63), in a different axis. The guide-arm (23) is fixed to the top track (6) top inner side using three screws on three holes (66) located at the top step side (65).

Figure 5:
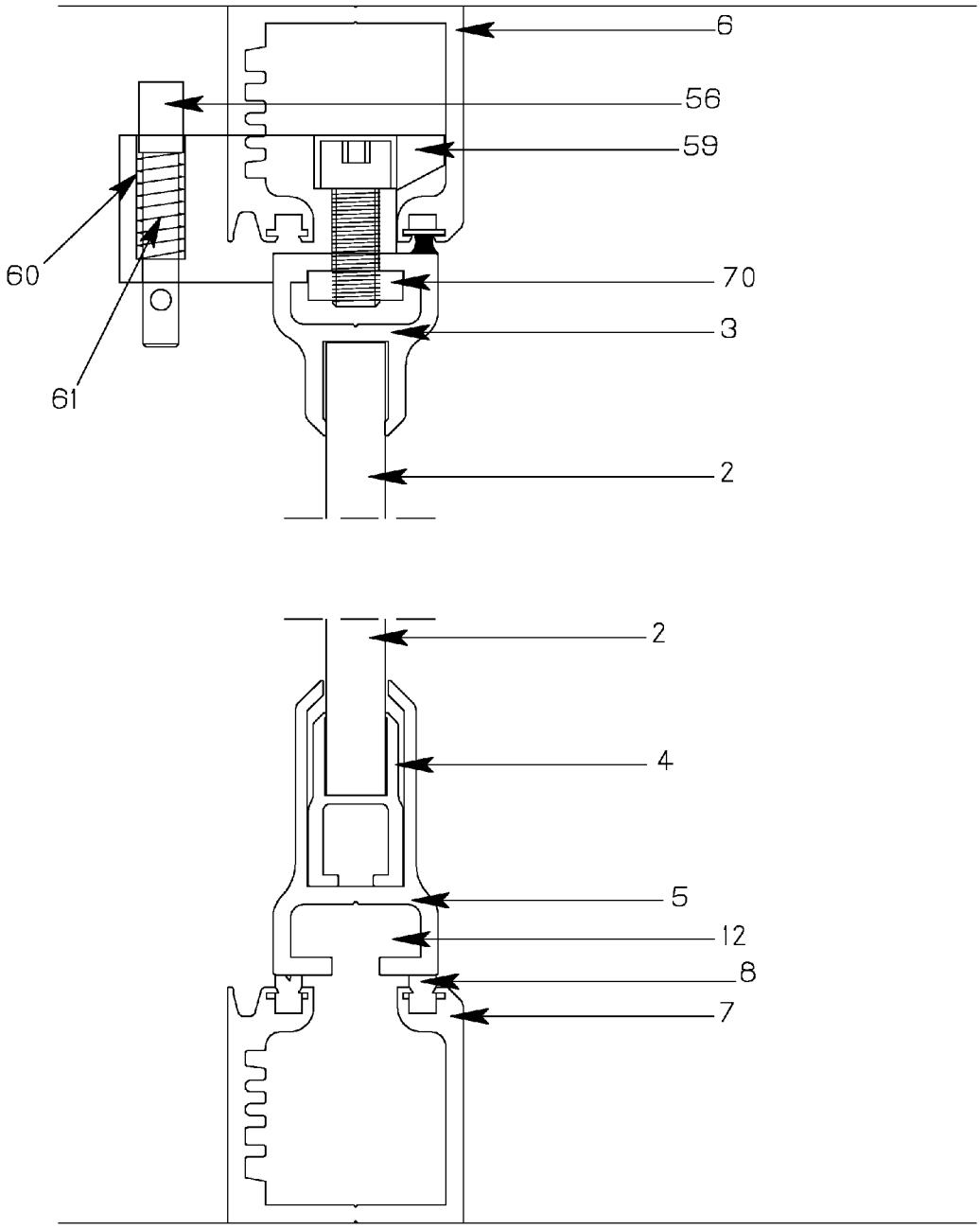
FIG. 5: Door cross-section, opposite view.
Figure 9:
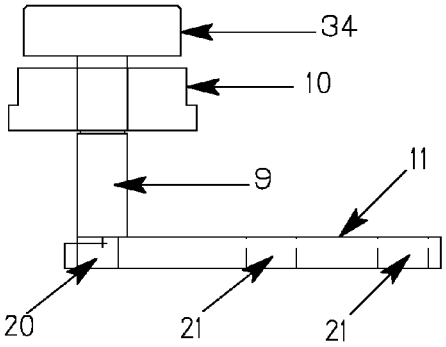
FIGS. 9 and 10: Top turning set cross section and top plan.
Figure 10:
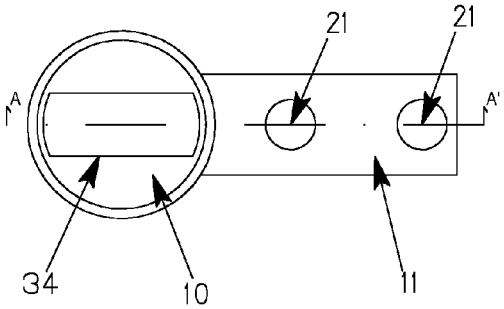
Figure 21:
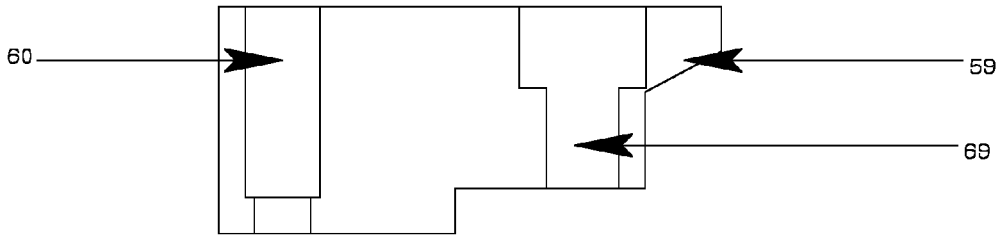
FIGS. 21 and 22: Locking system cross section and top plan.
Figure 22:
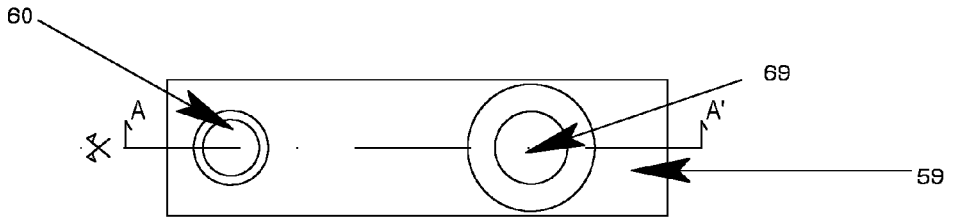

Through the hole done on the top track (6) interior side, and touching slightly the guide-arm (23), the top guide screw (30) and the hollow bushing (18) leave the top track (6). This light touch or levering on the guide-arm (23) makes the folding pivot movement of the panes (1) easier. When the pin (56) of the door (24) locking system (59) is inserted into the guide-arm (23) hole (57) that is closer to the top track (6), the door (24) is locked. Otherwise, when the pin (56) is inserted in the second hole (58) the door (24) is partially opened and locked so the air can pass through the system, this is called ventilation mode. FIGS. 5, 21 and 22 show the door (24) locking system (59) having a hole (69) for a bolt (26) that is screwed to the steel plate (70) placed inside the hole (39) of the top profile (3), this steel plate (70) is fixed to the top profile (4) by means of endless screws. The bushing (10) in the top turning set is made of plastic with a circular shape and is place inside the top track (6), and it has two layers fabricated in one block made of polyamide or similar material, as it is shown in FIGS. 9 and 10.

The steel plate (11), identical to the steel plate (12), it has a long shape and two threaded holes (21) of the same diameter and another hole with a semicircular shape (20) located along the longitudinal axis of the piece. The semicircular hole (20) is placed at one edge of the steel plate (11, 12).

The top T axis guide (9) is made of stainless steel and it has a T form. The head (34) of the axis (9) has two long straight arms with two small oval sides, in such a way that when it pivots this oval side touches the inner side of the spoon-shaped area (16) in the turning mechanism (15) that delimits the movement of the T axis. The base of the T axis guide (9) has a semicircular shape so it can match perfectly, by pressure, into the semicircular hole (20) in the edge of the steel plate (11). Therefore, the T axis guide (9) is perfectly aligned with the steel plate (11) axis.

The other two threaded holes (21) in the steel plate (11) are designed to place endless screws to fix the top turning set to the top profile (3) in each pane.

Figure 11:
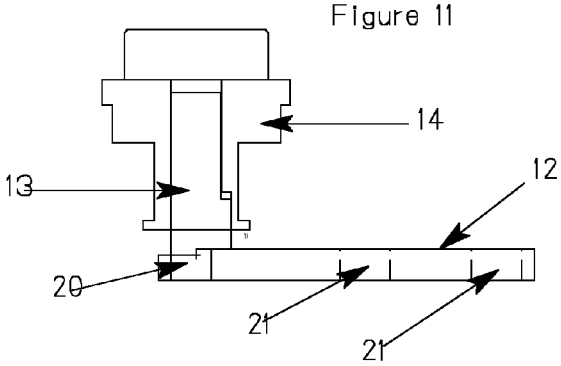
FIGS. 11 and 12: Bottom turning set top plan and cross section
Figure 12:
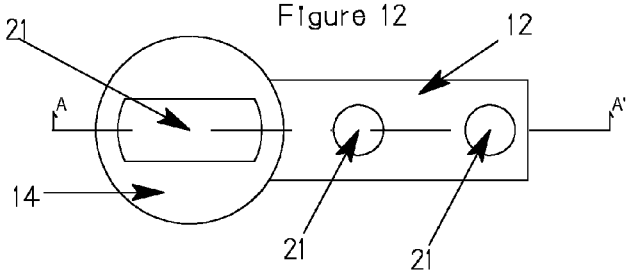

FIGS. 11 and 12 show the bottom turning set made of a steel plate (12), an axis guide (13) made of steel, and a bottom bushing guide (14) made of polyamide or similar material, with different layers. The set is fixed to the sliding bottom aluminum profile (5) by means of a steel plate (12), using two endless screws, inserted longitudinally in the trapezoidal hole (45) of the bottom sliding profile (5).

The bottom axis guide (13) crosses the bottom bushing guide (14). This axis (13) is made of steel and is fitted and welded to the steel plate (12) and the other end is inserted into the bottom bushing guide (14) hole, placed inside the bottom track (7). The bottom bushing guide (14) is made of polyamide or similar material and is fabricated in one block with 5 layers that travels along the bottom track (7) hole and guide the pane along that track (7):

- An oval base with two straight and long sides, designed to couple into the spoon-shaped area (16) of the turning mechanism (15).
- The biggest diameter cylinder that is in contact with the inner sides of the bottom track (7).
- Another transition cylinder working as a step between the top and bottom cylinder.
- The smallest diameter cylinder that is in contact with the interior sides of the opened area of the bottom track (7). This cylinder fits into the top opening of the bottom track (7).
- Finally, on top of the smallest diameter cylinder there is a fourth cylinder with a slightly bigger diameter than the size of the top opening of the bottom track (7) to hold this bushing and avoids that it falls into the hole of the bottom track (7).

Figure 4:
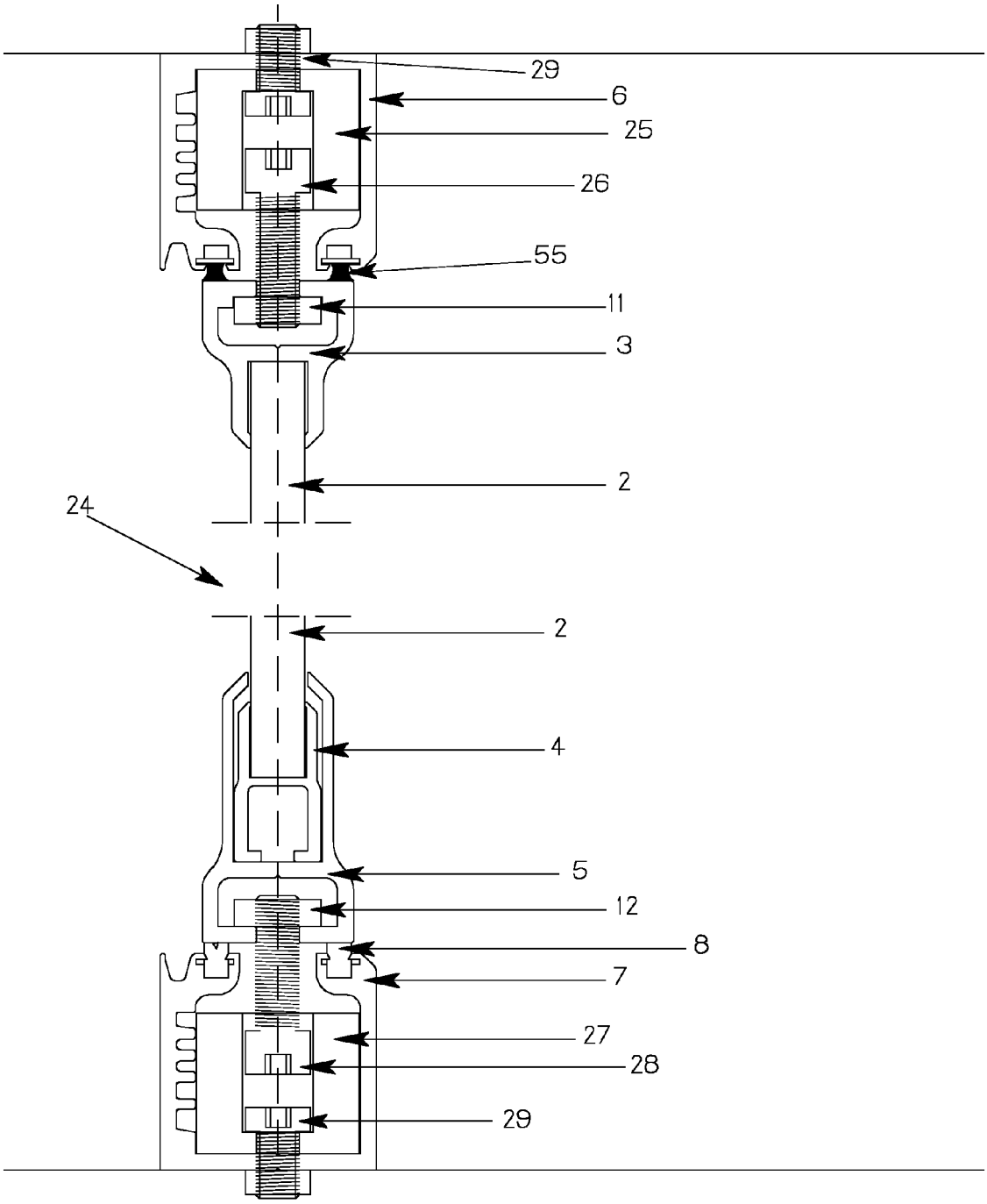
FIG. 4: Door cross-section.

FIG. 4 shows a cross section of the door (24) or opening pane. This is the only pane that doesn't slide and whose only possible movement is to pivot. As the panes (1), the top edge of the glass (1) is fixed to a top profile (3) and to a bottom profile (4) by means of a gluing material. This pane (24) works like a normal door. To do the pivot movement it has a top turning mechanism (25, 26, 11) and a bottom turning mechanism (12, 27, 28).

The operation of both mechanisms is based in an axis formed by screws (26, 28) and steel plates (11, 12) that fix those axes to the top profile (6) and the bottom sliding profile (7). These steel plates (11, 12) are fixed to the profiles (3, 5) using endless screws, not shown in this figure. These steel plates (11, 12) adjust the position of the axis in such a way that they can perfectly balance the door (24) position in relation to the top (6) and bottom track (7). The parts that enable the turning movement are two pivots (25, 27) with a cubic shape, made of polyamide or similar material. These two pivots (25, 27) are similar and have a central hole with two openings of different sizes. The one with the biggest diameter receives the head of the screw-axis (26, 28) and the one with a smaller diameter allows the fixation of these pivots (25, 27) to the floor and to the ceiling by means of screws (29).

FIG. 5 shows the opposite cross section of the door (24). The elements are the same as described in FIG. 4 except that the position of the top and bottom axes are occupied now by the top door locking system on the top, and a knob to lock the door at the bottom profile. These elements are fixed to the top profile (3) of the glass (2) and to the sliding bottom profile (5) using the same system of steel plates (11, 12) and endless screws.

FIG. 5 shows the door (24) locking system (59) has a small pin (56) that goes up and down and can block the door (24). The pin (56) up and down movement is achieved using a rod (60) and a small internal spring (61). The configuration of the locking system (59) makes the fixing by a screw to the top profile (6) possible.

Figure 6:
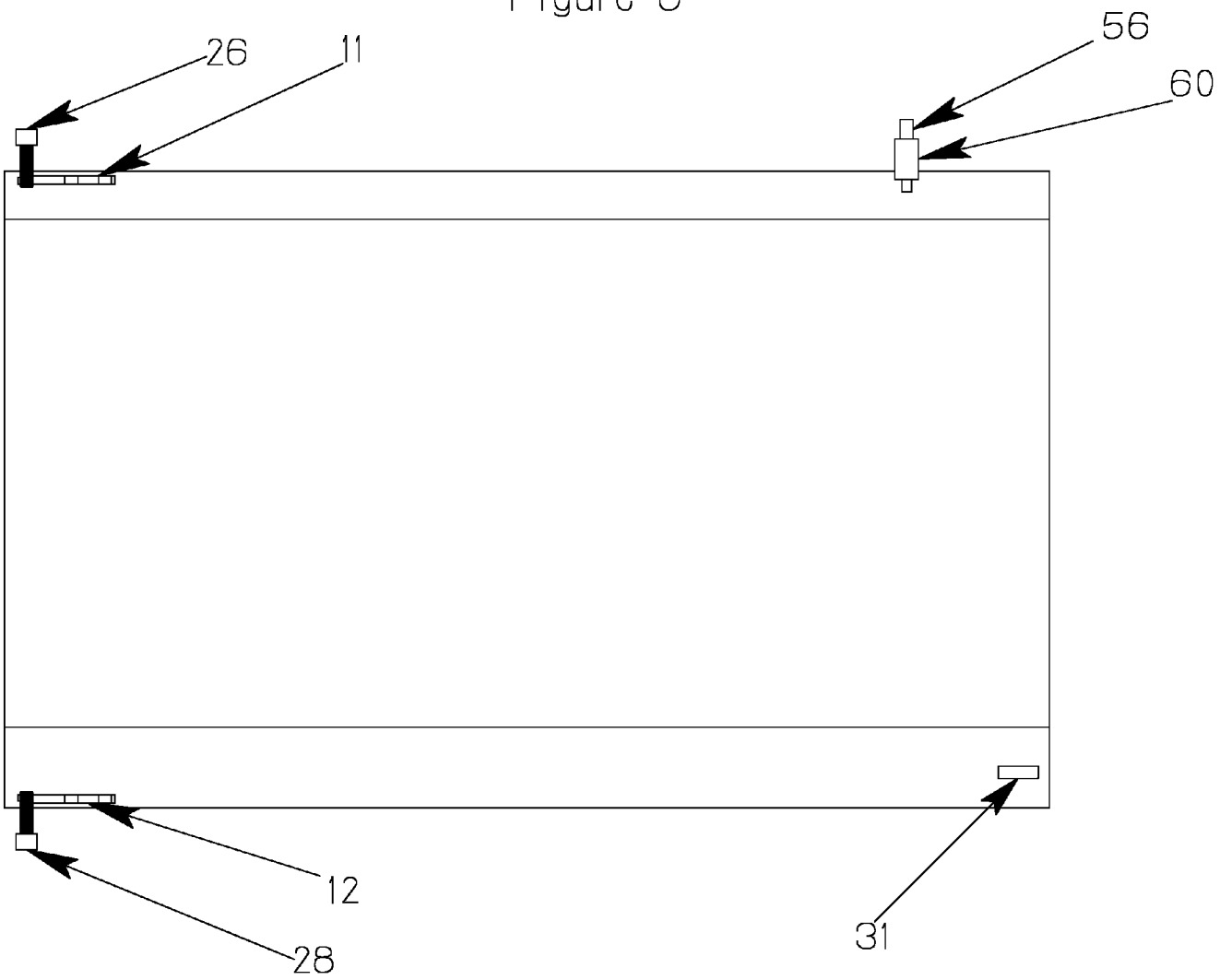
FIG. 6: Door side view.

FIG. 6 depicts a front view of the cross section of the door (24) including a rod that in conjunction with a bottom knob enable its opening and therefore the whole system can be operated. The former locking system is place in the interior face of the system, so it is not possible to open the system from the outside.

Figure 7:
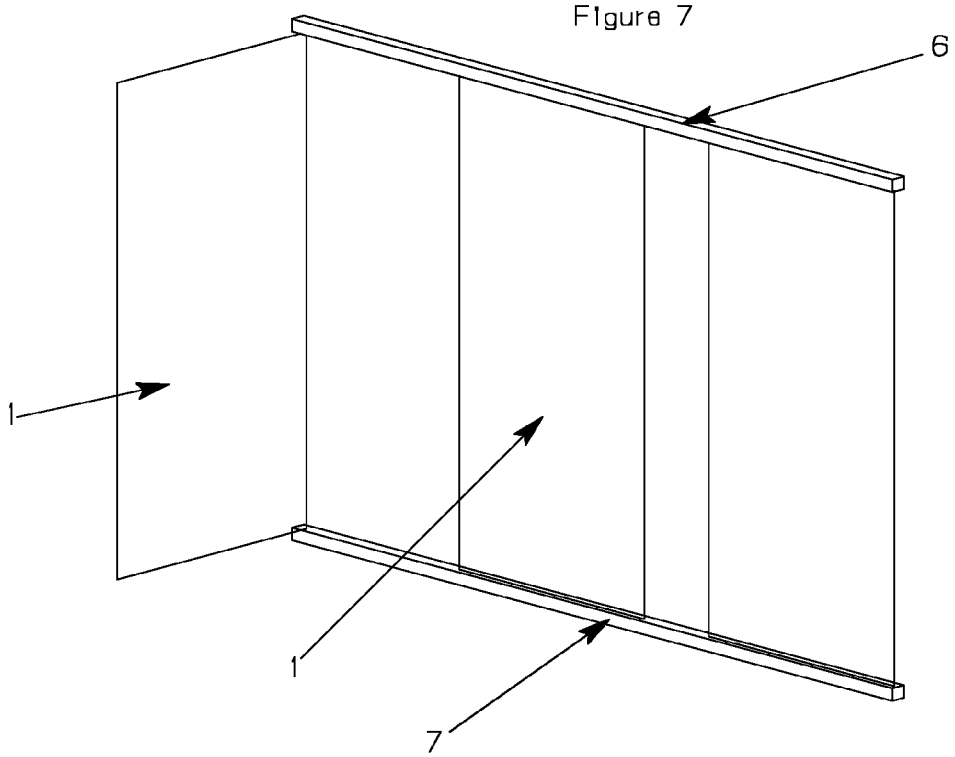
FIGS. 7 and 8: Set of panes, folded and unfolded partially, side elevation
Figure 8:
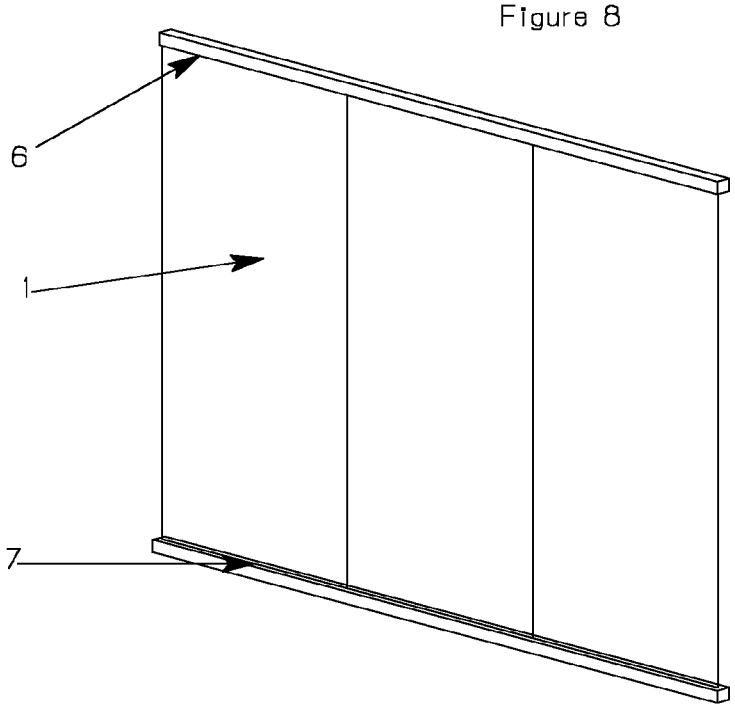

FIG. 7 shows on of the panes (1) in a perpendicular position and folded close to the door, this is the only place where the panes can be folded. Another pane (1) is deployed along the tracks (6, 7) in the unfolded position. FIG. 8 depicts a set of panes deployed longitudinally along the tracks (6, 7).

Figure 15:
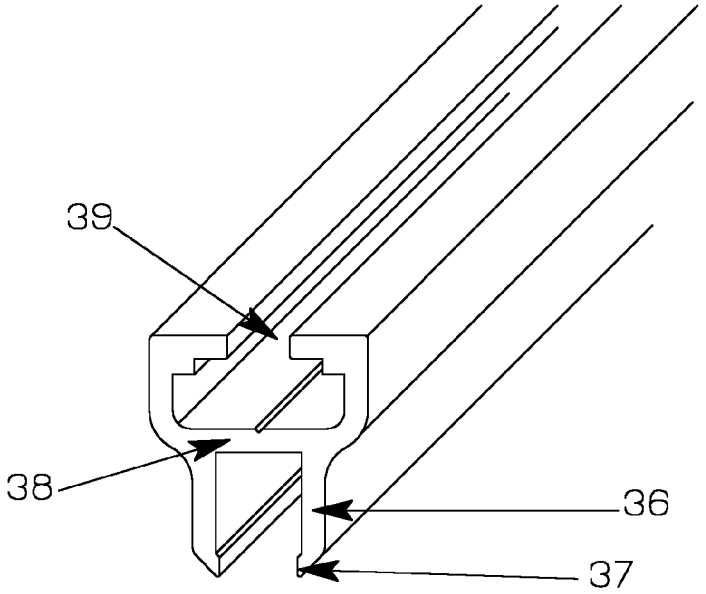
FIGS. 15 and 16: Top and bottom profile side elevation.

As shown in FIG. 15, the sides (36) have a flat arm shape and a flat base (38). Glass (2) is glued to the sides (36) and to the flat base of the top track (3). These side arms (36) end with two small protuberances (37) up to 0.5 millimeters long, for a better fixation of the glass (2) to the aluminum. The hole (39) inside the top track has an open rectangular shape. Inside the hole are placed the steel plates (11) to fix the T axis guide (9) and the top guide screw (30). These steel plates (11) hold the parts that fix each pane (1) to the top track (6).

Figure 16:
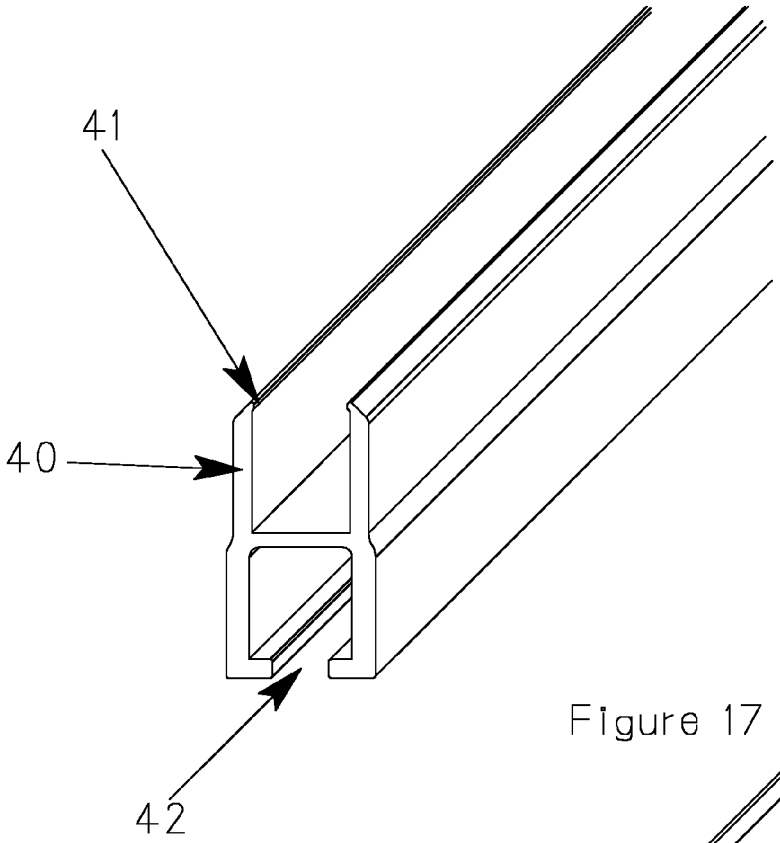

In the bottom aluminum profile (4), FIG. 16 shows that the side arms (40) end with a small protuberance each (41) up to 0.5 millimeters long, for a better fixation of the glass (2) to the aluminum. The rectangular open shape hole (42) can accommodate two screws that fix this profile (4) to the bottom sliding profile (5). These screws work also as height regulators of one profile to the other so the small imperfections in the glass (2) during its fabrication process, one side bigger than the other or slightly not squared sides, can be solved.

Figure 17:
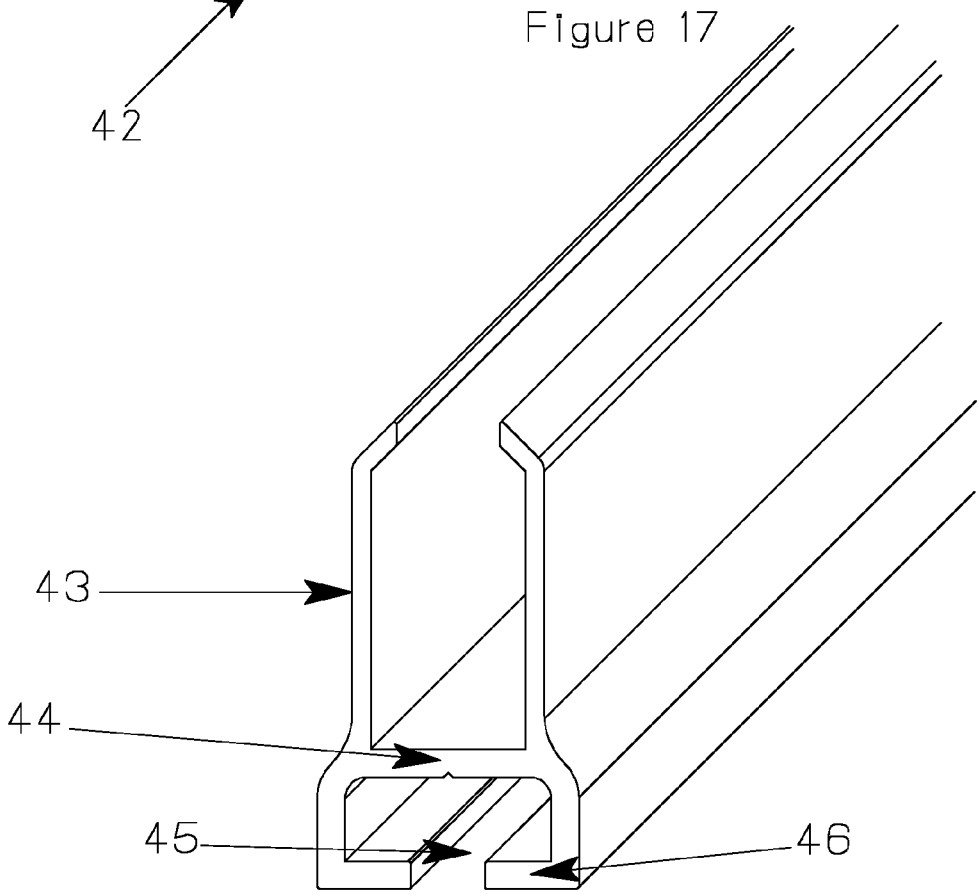
FIG. 17: Sliding profile side elevation.

FIG. 17 shows that the bottom sliding profile (5) has two straight arms (43) slightly curved on the upper area. The hole contained between those two arms (43) and the base (44) accommodates completely the bottom aluminum profile (4). The base (44) is drilled, so the screw that fixes this profile (5) to the bottom aluminum profile (5), can pass through it. Inside the hole (45) are placed the former screw and the steel plates (12) that fix the bottom axis guide (13) and also the H washer (19). These two elements allow the sliding movement of the panes (2) along the bottom track (7) and the pivot movement at the door (24) area. The outer sides (46) on the bottom of this profile rest on the strips, made of a homogeneous mixture of self-lubricating polymer (8), so the panes can slide along the bottom track (7).

Top (6) and bottom tracks (7) are identical. As seen in the FIG. 18, both tracks (6, 7) have a rectangular section, with a side (57) partially closed with an opening (56) that allows the insertion, and internal movement of the bottom turning set (12, 27, 28) and the top turning set (11, 25, 26). The opening (56) is defined by two equidistant sides of the track (7). One side (47) has a flat aluminum wall and the other one (48) has a set of protuberances (49) that forms a virtual wall, equidistant from the former wall. The top (6) and bottom track (7) are fixed to the floor and ceiling using nails, screws (59) or similar fixation elements. They drill into the notch, with a channel shape (51), all along the side opposite to the opening (56) in the tracks (6, 7). This channel (51) makes the drilling of the fixation elements easier when fixing the tracks (6, 7) to the floor and the ceiling. In the outer side of the arm (57) that forms the opening (56) there are three channels (52, 53, 54). Channels (52, 53) are equidistant and accommodate the strips made of a homogeneous mixture of self-lubricating polymer (8) in the bottom track (7) and accommodate wind and water protecting brushes (55) in the top track (6). Over those strips made of a homogeneous mixture of self-lubricating polymer (8) the panes (1) slide, resting all their weight on those strips (8). Channel (54) in the bottom track (7) is a water collection channel in case of any water leakage at the pane joints sections, as this is the most probable point of water and wind entry as it is a natural discontinuity of the glass. Water flows to the inside of the bottom track (7) trough some drills, parallel to the track direction, done in this channel (54) and the water flows out of the track through some exterior holes done during the installation of the system.

A variation of this windbreak system includes a sliding door that can be operated manually sliding along the top (6) and bottom track (7). This sliding door, not shown in the figures, has a pane (1) with a modified version of the bottom bushing axis guide of the panes (1), previously described, to ease the pivot movement of this sliding door. The rest of the components of the bottom turning set and the top turning set are identical to the other panes (1). Therefore, the bottom axis (13) is welded at the hole (20) in the semicircular section of the steel plate (12), as in the rest of the panes (1). This steel plate (12) is placed inside the bottom sliding profile (5) hole. This bottom axis (13) crosses and holds a bushing, not shown in the drawings, with five layers, in a very similar fashion to the bushings (14). Therefore, the sliding door bushing, made of polyamide or a similar material, has this configuration:

- A bottom cylindrical base designed to fit by pressure in the semicircular hole (32) of a plate (31) fitted inside the bottom track (7).
- A bigger diameter cylinder that is in permanent contact with the vertical inner walls of the bottom track (7).
- Another transition cylinder working as a step between the top and bottom cylinder.
- The smallest diameter cylinder that is in contact with the sides of the opened area of the bottom track (7). This cylinder fits the top opening of the bottom track (7).
- Finally, on top of the smallest diameter cylinder there is a fourth cylinder with a slightly bigger diameter than the size of the top opening of the bottom track (7) to hold this bushing and avoids that it falls into the bottom track (7) hole.

Figure 23:
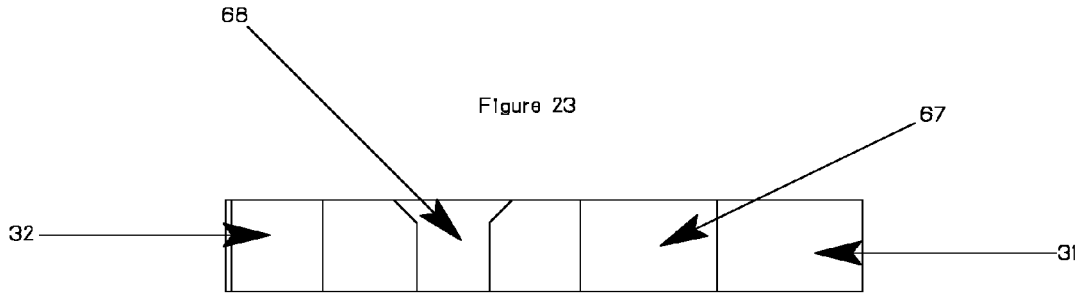
FIGS. 23 and 24: Sliding door bottom pivot set cross section and top plan.
Figure 24:
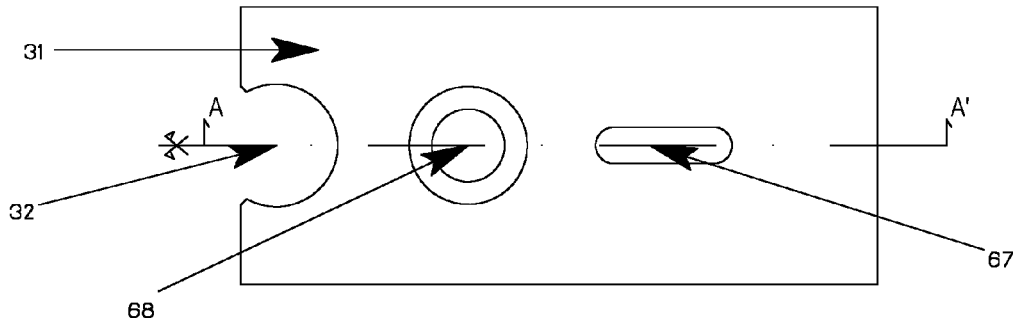

As depicted in FIGS. 23 and 24, this plate (31) has a long rectangular shape and it has a long hole (67), a circular one (68) and an opening (32) with the shape of a semicircular notch in the edge closer to the hole (68). These three elements are in line. The long hole (67) is used to position the plate (31) inside the bottom track (7) being fixed by a screw that drills the channel (51) in the bottom track. The second hole (68) is crossed by a screw that fixes the plate (31) to the interior of the bottom track (7). The semicircular notch (32) has a diameter equals to the cylindrical base of the sliding door bottom bushing. Therefore, this set of the semicircular notch and cylindrical base work as the pivot axis for the sliding or flying door. The pane of the sliding or flying door is an intermediate solution between a pane and a door. This configuration adds flexibility to the system as it allows positioning the sliding door in the other endpoint of the track, opposite side of the door (24). The sliding door is folded like the rest of panes (1), close to the door (24), once all the panes (1) have been folded, and the sliding door is the first to be unfolded when all the panes (1) are folded.

This sliding door can be placed in the other endpoint of the track, opposite side of the door (24). To allow the opening of this door and leave the tracks (6, 7) in the other endpoint of the track, at the opposite side of the door (24) a hole is done in the top track (6) with a size of one centimeter bigger than the diameter of the top bushing guide (18) and a notch in the polymer strip (8) with a size of one centimeter bigger than the diameter of the H washer (19), both located at the same distance from the sliding door pivot axis and in a position where the sliding door is going to be open and close.

Another possible configuration is having two doors (24), in each endpoint of the system and a sliding door that can be open and close in the middle of the system.

ALTERNATE EMBODIMENT

The present invention may also be comprised of the following alternate embodiment which includes 13 modifications including new version and additional parts in order to improve the fitting process and the system performance.

Figure 25:
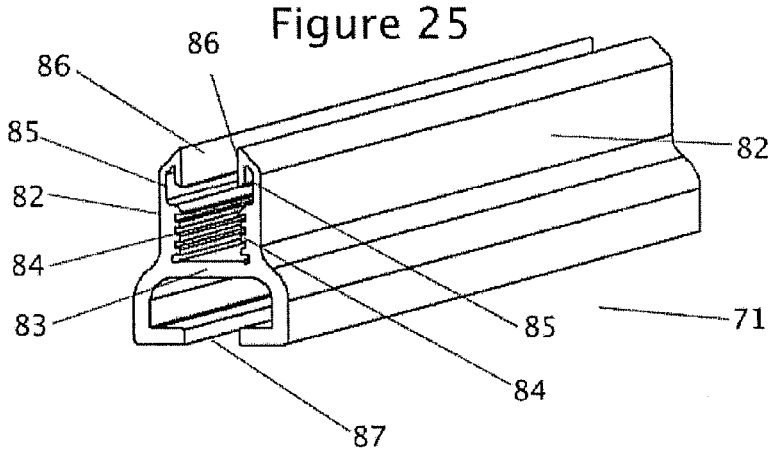
FIG. 25: Top profile side elevation

First, wherein a top profile (71) of the alternate embodiment is described as depicted in FIG. 25. The glass (2) is glued to the side arms (82) and the flat base (83) of the top profile (71). These sides (82) have an arm shape, having on their inner faces small protuberances (84), teeth like, to improve the glass (2) and aluminum profile (71) union. Both arms (82) have a cavity (85) on the top area to collect the excess of glue that could leak out of the profile during the glass (2) gluing process. The terminations of these arms (82) have two flat sides (86) to hide the view of the bonding material that fixes the glass and aluminum from the outside. This way, a wide range of gluing materials, in different formats and colors, can be used. The bottom area of the profile has an inverted "U" shape hole (87) to insert and fix the top turning set (75) and top guide set (77).

Figure 26:
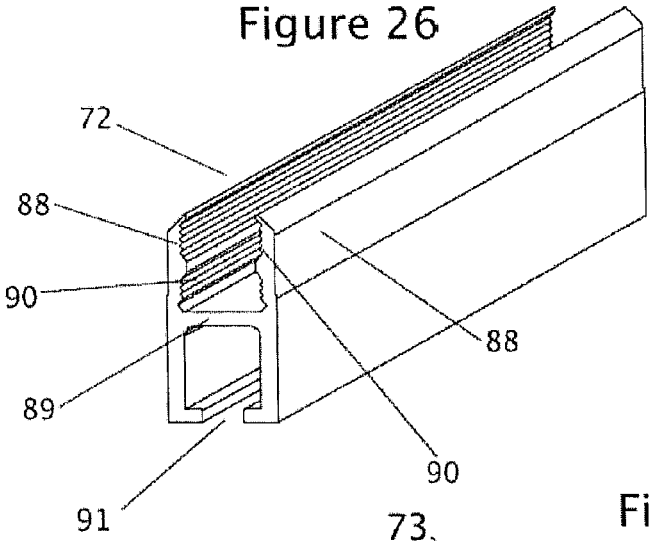
FIG. 26: Bottom profile side elevation.

Second, wherein a bottom profile (72) of the alternate embodiment, as shown in FIG. 26, is described. The glass (2) is glued to the side arms (88) internal faces and to a flat base (89) of the bottom aluminum profile (72). As in the top profile (71), side arms (88) have, on their interior face, small protuberances (90), teeth like, up to 0.5 mm long, to improve the bonding between the glass (2) and the aluminum profile (72). The bottom area of the profile has an inverted "U" shape hole (91) to insert two bolts, not shown in the figure, that fix this profile to the bottom sliding profile (5) base and allow a height regulation of this profile (72) inside the other one to overcome the glass (2) imperfections originated in the glass cutting process. This makes possible to align a big side of a pane to another or slightly not squared.

Figure 27:
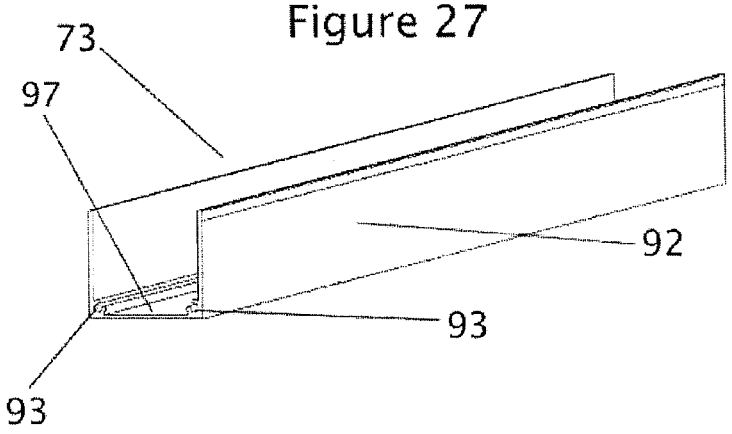
FIG. 27: Leveling profile side elevation.
Figure 28:
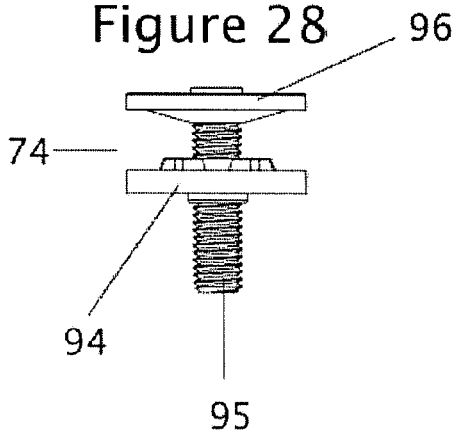
FIGS. 28 and 29: Leveling set side view and side elevation.
Figure 29:
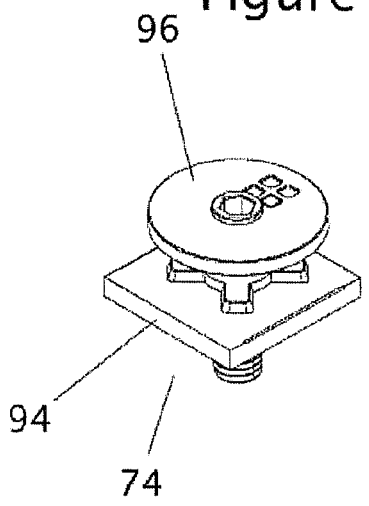

Third, wherein a "U" shaped leveling profile (73), as shown in FIG. 27 is described. The leveling profile (73) base (97) accommodates the leveling sets (74), as shown in FIGS. 28 and 29. The leveling set is formed by an eccentric bolt (94) and a flat head screw (95). The screw (95) has a head (96) with a diameter big enough to assure a stable support of the aluminum track (7), the height of the screw (95) is design to level the track on uneven floor or ceiling surfaces. The eccentric bolt (94) has the precise dimensions to fit perfectly on the leveling profile (73) base and avoid any undesired movement and also provide a stable support basement for the whole system. On top of the leveling sets (74) is placed the bottom track (7). The side arms (92) of the leveling profile (73) centre the track (7) and hide the leveling sets (74) and fixation screws (50). The leveling profile base has two corner holes (93) to insert a cap, not shown in the figures, to avoid indoor water leakage at the track ends.

Figure 30:
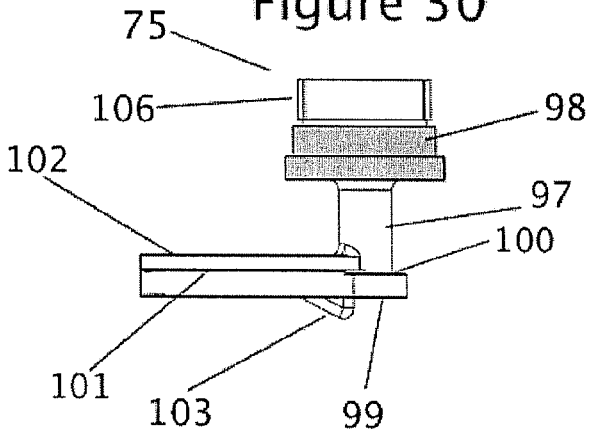
FIGS. 30 and 31: Top turning set side view and side elevation.
Figure 31:
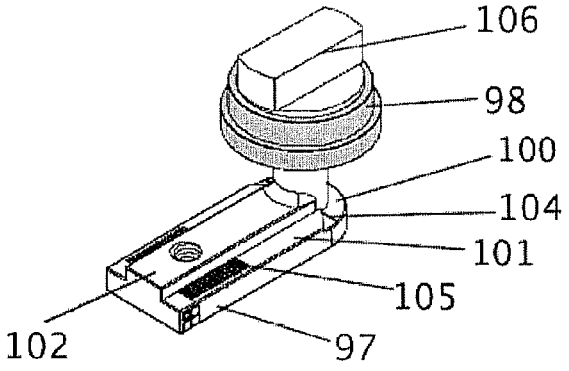

Fourth, wherein a top turning set (75), depicted in FIGS. 30 and 31, has a metal body (97) and a top guide bushing (98). The metal body (97) is made in one piece by injection, assuring the part measurements and symmetries, for a perfect operation and eliminating the possible differences in different production batches.

The base of the metal body (97) is a plate (99) with three layers (100, 101, 102) and a protuberance (103):

First layer (100) assures the right coupling in between the panes (1) when they are being deployed. This layer (100) has a reference mark (104) to insert this set (75) into the top profile (71) in the correct position, in such a way that all the panes will have the sets fitted at the same distance.

On the second layer (101) there are small, teeth like, protuberances (105), up to 0.5 mm long, to fix tightly the set to the aluminum top profile.

The width of the third layer (102) assures a centered position of the set (75) in relation to the pane (1), as it has the same width as the top profile (71) opening (87).

The protuberance (103) has a wedge shape to support the set body and to assured a vertical position of the axis (106) over the top aluminum profile (71), and removing a second screw present in the former version of this set (75).

Figure 32:
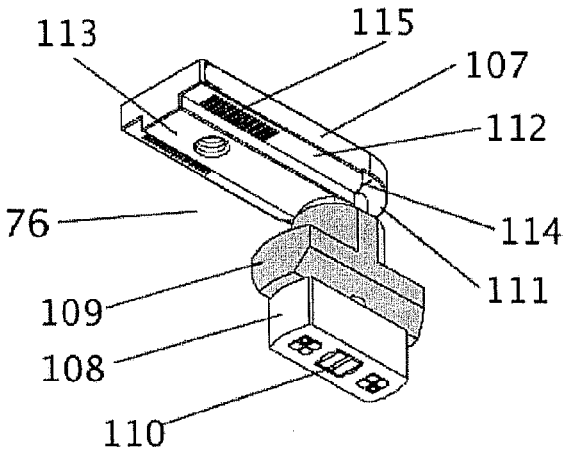
FIGS. 32 and 33: Bottom turning set side view and side elevation.
Figure 33:
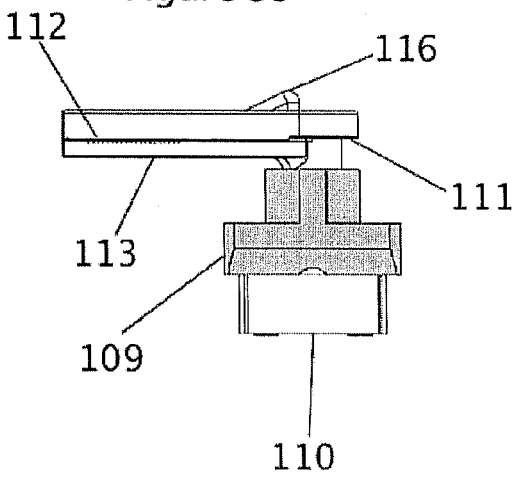

The top guide bushing (98) has a circular shape and two layers. It is one piece made of polyamide or similar material. This bushing (98) is inserted by pressure into the rounded axis metal head of the top turning set (75). The outer diameter in the bushing (98) assures the position of the pane (1) in relation to the top track (6) and avoids noises when the panes (1) are sliding, Fifth, wherein a bottom turning set (76) replaces the previous one. As shown in FIGS. 32 and 33 this bottom turning set (76) has a metal part with two bodies (107, 108) and a bottom guide bushing (109). The metal part is form by two injected metal bodies (107,108), assembled by a square click locking joint (110), that allows a part to enter into the other one but not to exit from the other one, it creates a rigid union that can't be disassembled, this way is assured that parts measurements and symmetries, for a perfect operation and eliminating the possible differences in different production batches.

The base of the metal body (107) is a plate with three layers (111, 112, 113) and a protuberance (116):

First layer (111) assures the right coupling in between the panes (1) when they are being deployed. First layer (111) has a reference mark (114) to insert this set in the correct position in such a way that all the panes will have the sets (76) fitted at the same distance in the aluminum bottom sliding profile (5), and assuring the right longitudinal position of the set (76) in relation to the bottom sliding profile (5).

Second layer (112) has on its surface small protuberances (115) to fix tightly the set (76) to the aluminum bottom sliding profile (5). This way, the protuberances (115) improve the fixation of the set (76).

The width of the third (111) layer assures a centered position of the set in relation to the bottom sliding profile (5), as it has the same width as the profile opening.

The protuberance (116) has a wedge shape to support the set body and to assured a vertical position of the axis (110) in relation to the bottom aluminum sliding profile (5), and removing a second screw present in the former version of this set.

The bottom guide bushing (109) has a "T" shape, side faces are flat and the front and rear ones are rounded. The bushing width (109) is smaller than the aluminum track (7) opening (56), therefore the panes (1) can be mounted and dismounted without the need of a hole in the track (7). The bottom guide bushing (109) is centered in relation to the set axis, but is not fixed, making possible to keep the parallelism between the flat sides of the bushing (109) and the aluminum track (7). The bottom guide set (76) solves a problematic situation present in the former version, as during the installation process it was necessary to insert a metal pin inside the plastic bushing, a delicate process that sometimes broke the plastic bushing. Also this breaking could happen if the operation of the panes was not correct or an object could fall inside the track and block the normal operation of the bushings. This breakage involved dismounting the whole system as the former bushing can't be introduced into the track from the top, it has to be done from one side of the track. So, there is no need to design a specific hole in the track as this version allows the top-down insertion into the track. Therefore, the bushing (109) width allows the panes (1) to be mounted and dismounted without the need of a hole in the track to insert these sets inside.

Figure 34:
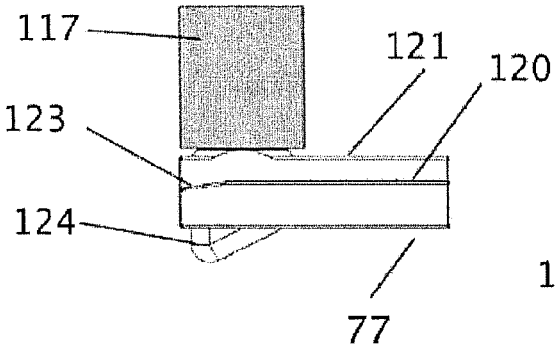
FIGS. 34 and 35: Top guide set side view and side elevation.
Figure 35:
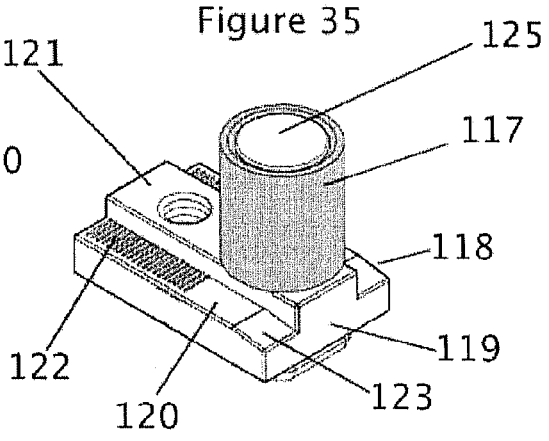

Sixth, wherein a top guide (77) replaces the previous one made of a bushing (18) and a screw (30). As shown in FIGS. 34 and 35, the top guide set (77) of the alternate embodiment has a metal body (18) and a top guide bushing (117).

The metal body (118) is made in one piece by injection, this way is assured that parts measurements and symmetries, for a perfect operation and eliminating the possible differences in different production batches. The metal body is a plate (119) with two layers (120, 121), an axis (125) and a protuberance (124). On the first layer (120) there are small, teeth like, protuberances (122), to fix tightly the set to the aluminum top profile (72). This layer (120) has a downward slope (123) at its front end to ease the movement of the set (75) along the top profile (71) longitudinal hole. The width of the second layer (121) assures a centered position in relation to the pane (1), as it has the same width as the profile (71) opening. The protuberance (124) has a wedge shape to support the set body and to assured a vertical position of the axis (125) over the top aluminum profile (71), and removing a second screw present in the former version.

The top guide bushing (117) has a circular shape and two layers. It is one piece made of polyamide or similar material. This bushing (117) is inserted by pressure into the cylindrical axis (125) head of metal body (118). The outer diameter in the bushing (117) assures the centered position of the pane (1) in relation to the track (6) and avoids noises when the panes (1) are sliding.

Figure 42:
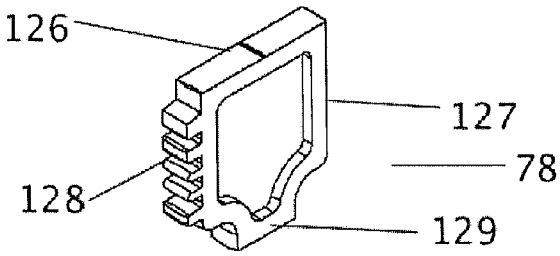
FIG. 42: Cap for track ends side elevation.

Seventh, wherein a cap (78) is placed at the ends of the bottom track (7). As shown in FIG. 42, the cap (78) shape is the same as the track (7) hole, so it can fit in perfectly. So the bottom side (126) is flat and the top side (129) narrows so it can fit into the hole (56) shown in FIG. 51. One vertical side (127) is flat while the other vertical side (128) has a contour with protuberances so it can fit perfectly into the protuberances (49) of the bottom track (7). The cap (78) is made in one piece by injection, this way the measurements are assured to be the right ones for a perfect coupling to the track (7) and achieving a hermetic termination in the track ends.

Else more, the bottom track (7) has small drills, not shown in the figures, in the outdoor side. So the any water coming into the track (7) from the panes (1) vertical joints sections can flow outdoor. So these caps (78) assure that water will flow through these small drills on the track (7) outdoor side instead of flowing through the track ends, normally in contact with the walls.

Figure 36:
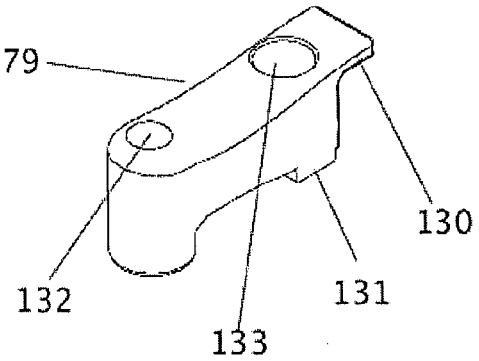
FIGS. 36 and 37: Locking block side elevation and side view.
Figure 37:
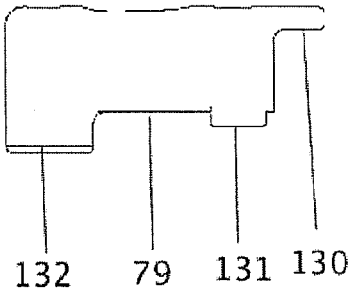
Figure 38:
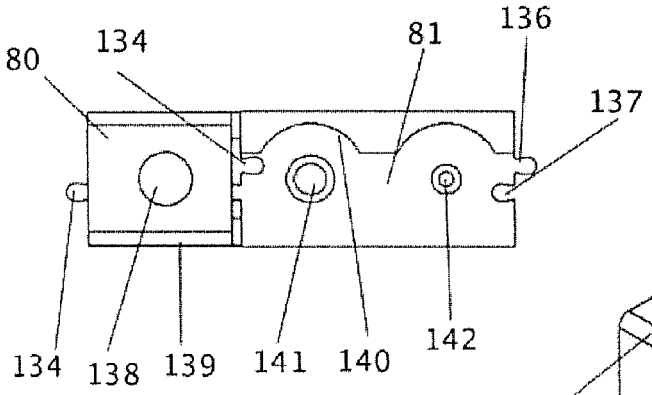
FIGS. 38 and 39: Pivot block and turning mechanism side view and side elevation.
Figure 39:
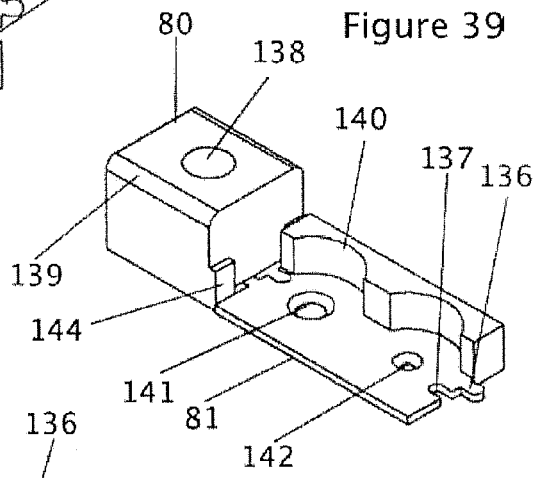
Figure 40:
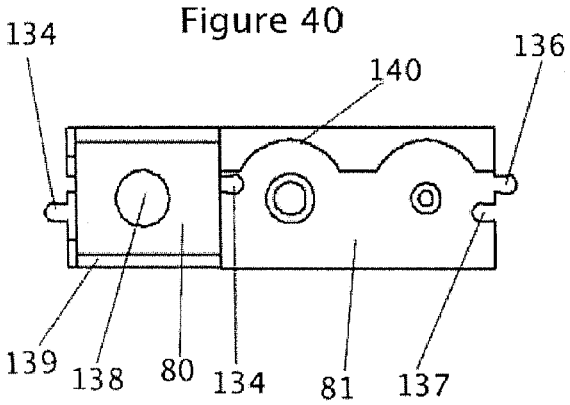
FIGS. 40 and 41: Pivot block and turning mechanism top plan and side elevation in a different configuration.
Figure 41:
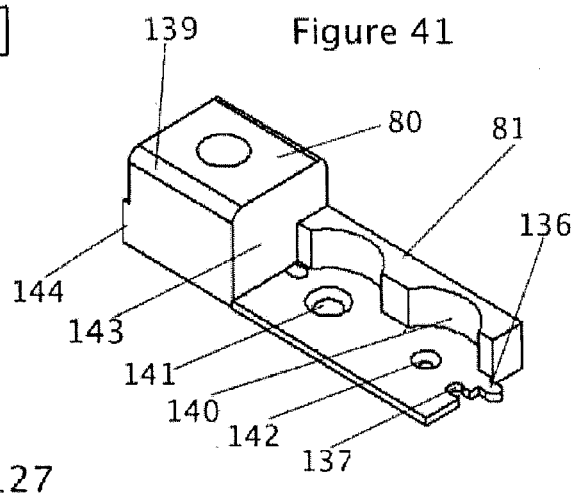

Eighth, wherein a different top locking block (79) replaces the former locking mechanism described in FIGS. 21 and 22. FIGS. 36 and 37 show this top locking block (79) having on its base a protuberance (130) aim to position it perpendicularly to the top aluminum profile (71), avoiding any possible movement of this block. In the front side there is another protuberance (131) working as a stopper against the interior side of the top aluminum profile (71), positioning the door (24) in relation to the top aluminum track (71). This way, the door (24) is in line with the rest of the panes (1). These protuberances (130,131), position the block in relation to the top aluminum profile (71) and the top track (6), avoiding accidental marks on the outer faces of these profiles (6, 71) during the installation. The block (79) is made in one piece by injection, assuring a perfect coupling to the top aluminum profile (71), and avoiding differences in measurements in different production batches. The shape of block (79) is a rectangular parallelogram with two protuberances (130,131) and a semicircular side with a hole (132) with a higher height over the rest of the block (79) top side. A hole (133) with a bigger diameter than the former hole (132) is in the opposite side, having these holes (132, 133) the same use as the holes (60, 69) in the former door (24) locking mechanism.

Figure 43:
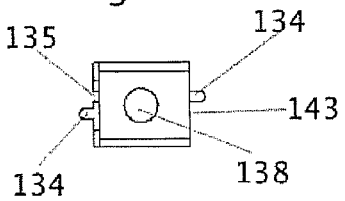
FIGS. 43 and 44: Pivot block top plan and side elevation.
Figure 44:
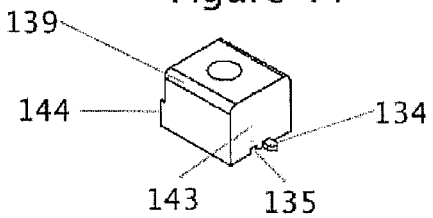

Ninth, wherein a pivot block (80) and a turning mechanism set (81) replace former turning mechanism (15). As shown in FIGS. 43 to 46 this set (80, 81) has two components:

Pivot block (80), shown in FIGS. 43 and 44, replaces the polyamide cubic shape pivot block (25) in the turning mechanism (11, 25, 26) described in the first patent request. Pivot block (80) has a rectangular shape in all its sides, and a hole (138), where the door (24) axes are inserted, that is slightly not centered as the top and bottom axes must have a shift between them for the correct operation of the panes (2). External sides of the pivot block (80), in contact with the vertical sides of the tracks (6,7), have a flat face and the other two sides (143,144) have a protuberance (134) and a hole (135) each, on their bottom. These protuberances (134, 136) have identical shapes and the holes (135, 137) also have the same geometry in such a way that protuberances (134, 136) fit into the holes (135, 137). Else more, one side (144) has a rectangular extension to match a perfect coupling with the turning mechanism (81).

Figure 45:
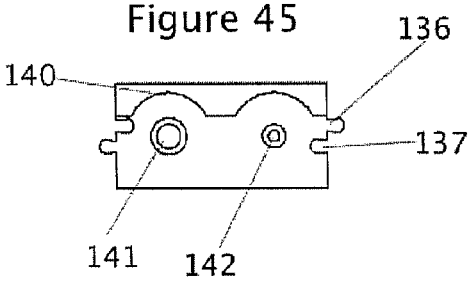
FIGS. 45 and 46: Turning mechanism module top plan and side elevation.
Figure 46:
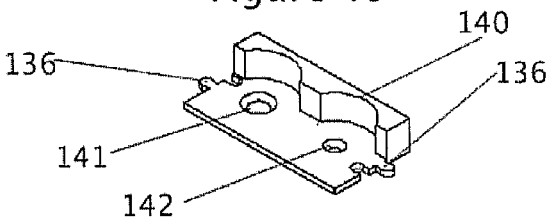

The turning mechanism (81), FIGS. 45 and 46, replaces the one in FIGS. 44 and 45. The turning mechanism (81) has the same protuberances (136) and holes (137) as the pivot block (80) but in a reverse position, so the pivot block (80) and the turning mechanism (81) can be assembled perfectly. When both parts (80, 81) are assembled they form a single block, so they cannot be split. In the side not matched to the pivot block (80) can be assembled another turning mechanism (81) and so on, up to the number of spoon-shaped areas necessary, as many as panes (2). The turning mechanism (81) has two holes (141, 142). The hole (141) closer to the block pivot (80) has a bigger diameter than the other one (142), and is used to fix the tracks (6,7) to the floor and the ceiling, and the smaller one (142) is used to fix the turning mechanism (81) to the tracks (6, 7). The turning mechanism (81) has two spoon-shaped areas (140) as in the old version of the turning mechanism (15).

The turning mechanism (81) and pivot block (80) set can be used on bottom, FIGS. 43 and 44, and top, FIGS. 45 and 46, of the windbreak system, and in any other possible opening configuration (right, left, interior, exterior) without any mechanical operation in the components. To achieve this, the pivot block (81) on the bottom must be assembled to the spoon-shaped areas plate, turning mechanism (81), using a different protuberance (134,136) and hole (135,137) than the one used in the top pivot block (80), as the axis hole position is not symmetric in the longitudinal axis defined by the longest sides of the block. This way, the installation process is easier and more reliable than the one described in the former patent request. Moreover, it is not necessary any mechanical operation for fitting them.

Figure 47:
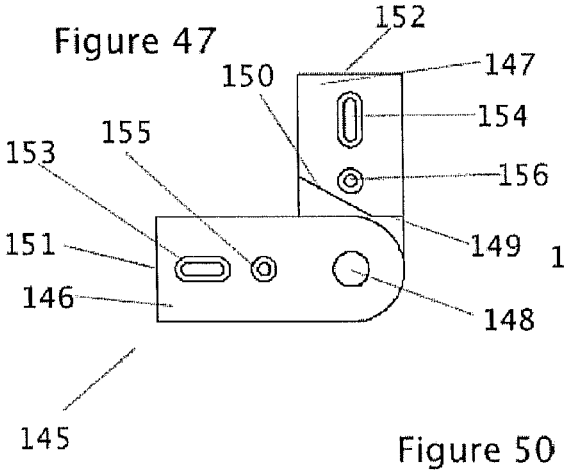
FIGS. 47 and 48: Two-part adjustable corner plate top plan and side elevation.
Figure 48:
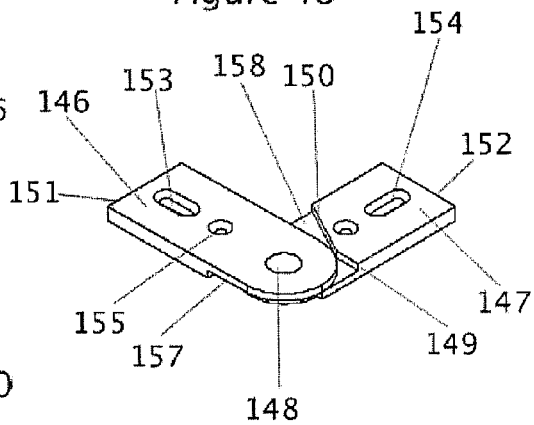

Tenth, wherein a two-part adjustable corner plate (145) can couple different sections, it can happen when there is an angle and two tracks must be connected. Moreover, the two-part adjustable corner plate assures that both sections won't move once they are assembled during the operation of the system. FIGS. 47 and 48 show that the two-part adjustable corner plate has two identical plates (146,147) connected by a joint section (148) in the plates (146,147) rounded shape sides. These semicircular ends have a step so they can couple by means of the joint section. This step is delimited by two straight edges (149, 150) forming an interior angle of 270°. The angle formed by these two edges (149,150) allows the set (145) to be used to articulate sections with two tracks (6, 7) within a range of 45° to 315°. The other small sides (151, 152) are straight. Along the central axis of the plates (146, 147) there is an oval hole (153, 154), whose longer axis is parallel to the longer sides of the plate, and a circular hole (154, 155), being the oval ones closer to the small straight side of the plates (146, 147).

The oval hole (153, 154) is always used before the other one when placing the plates (146, 147), as it allows a regulation on the track connection process. The second hole (155, 156) is used for the final fixing of the set (145), once the tracks are connected properly. The plates (146, 147) are made in one piece each by injection.

Figure 52:
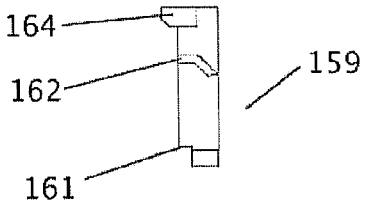
FIGS. 52 and 53: Metal axis element side view and side elevation
Figure 53:
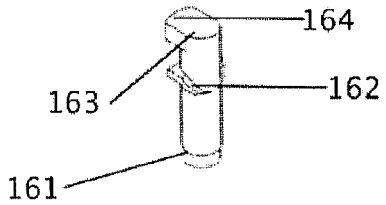

Eleventh, wherein a top turning set eliminates the need of using the guide-arm (23) when folding the panes as described in the former patent request. This set is formed by a metal axis element (159) and a blocking bushing (160). The metal axis element (159), FIGS. 52 and 53, has a cylindrical shape with three different areas (161, 162, 163). The bottom area (161) of the axis has a semicircular shape to be inserted in a fixing plate (70). Around the middle of the axis there are two wings (162) connected, with an element having the shape of a ramp. This ramp will allow the blocking bushing (160) to slide up the axis until it reaches the pivot position at the top turning mechanism (81) height. At the top of the axis there is a head (163) with a small ramp that will press the blocking bushing (160) down the axis when the pane is going to be deployed, so it can leave the top turning mechanism. The front side of the head (164) has a rounded shape and will block the pane (1) when folded, as the axis rotates approximately 90° in relation to the blocking bushing (160), being blocked to the interior semicircular faces (165).

Figure 49:
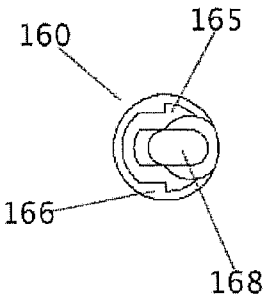
FIGS. 49, 50 and 51: Blocking bushing top plan, side view, and side elevation.
Figure 50:
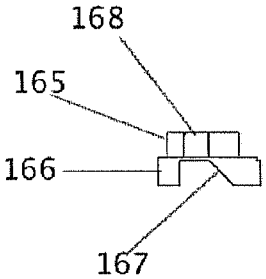
Figure 51:
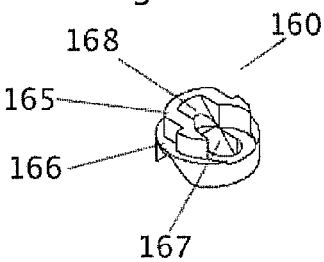

As depicted in FIGS. 49 to 51, the blocking bushing (160) has a circular shape, with a central hole (168) and two layers (165, 166). The top plan view shows that the hole (168) has an oval shape with straight arms in such a way that this hole (168) couples to the metal axis element (159). The first layer (165), the one with the bigger diameter, has a ramp (167) that will elevate the bushing (160), as it slides up on it, until the blocking bushing (160) reaches to the top turning mechanism (81) height. The second layer (165) is symmetric to the central vertical axis and has an interior ramp (167) in the inner hole (168) and two rounded sides (165) to block the metal axis element (159) when the pane (1) starts the rotation movement. When the pane (1) is going to be deployed the central ramp (167) of the blocking bushing (160) will slide down along the axis head ramp (162) and will press down the blocking bushing (160), therefore leaving the top turning mechanism (81).

The metal axis element (159) and the blocking bushing (160) are made in one piece by injection assuring the part measurements and symmetries are the right ones, for a perfect operation and eliminating the possible differences in different production batches. As both parts (159, 160) form a set, it is not necessary to leave any tolerance, this way, the pane (1) is perfectly blocked since the beginning of the folding movement, so the guide-arm (23) to hold the pane (1) during this movement is not necessary anymore.

Figure 54:
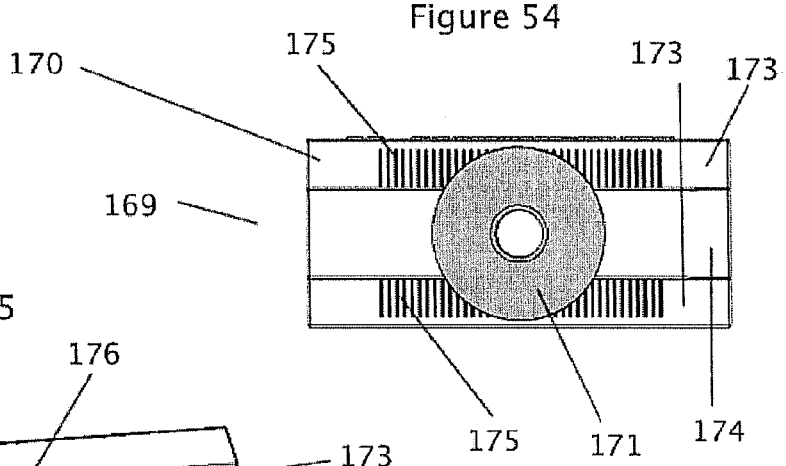
FIGS. 54 and 55: Bottom guide top plan and side elevation of the alternate embodiment.
Figure 55:
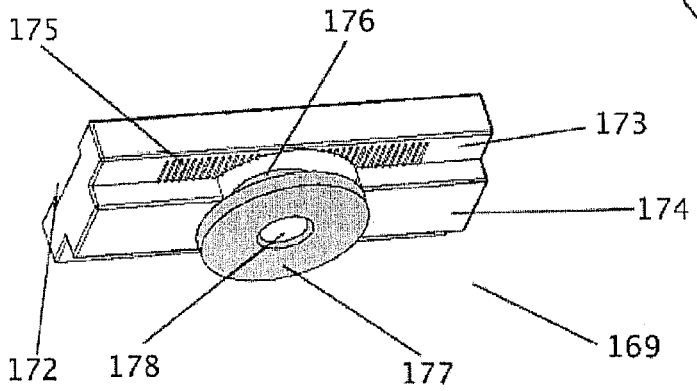

Twelfth, wherein a bottom guide (169), having a metal plate (170) and a washer (171), made of polyamide or similar material, as shown in FIGS. 54 and 55, replaces the former one (12, 13, 14, 20, 21). The base of the metal body (170) is a plate with two layers (173, 174). On the first layer (173) there are small, teeth like, protuberances (175), up to 0.5 mm long, to fix tightly the set (169) to the aluminum bottom profile (5). The opposite side of the first layer (173) base has a channel (172) with a width equal to the width of the opening (45) of the aluminum bottom profile (5), so the pane (1) and the set (169) are both in line. The height of the second layer (174) is the same as the thickness of the base of the bottom profile (5), so when this plate is fixed, this layer (174) will be at the same level as the base of the bottom profile (5) making the base at this point, a flat continuous surface. The plate (170) is made in one piece by injection to assure that all the measurements and symmetries are correct. This way, the set will work properly and will eliminate the minor differences among the plates in different production batches.

The washer (171), made of polyamide, has a round shape and a hole along its vertical axis, having two layers with different diameters. The bigger diameter layer (177) is designed to keep the pane (1) in line with the aluminum bottom track (7). The washer head (176) has a smaller diameter than the former and is used to couple with the metal body (170), by an arrow lock or click system, keeping these parts (170, 171) together. Nevertheless, the washer (171) can rotate freely as its cylindrical interior hole (178) matches a cylindrical pin, not numbered in the figure, based on the first layer (173) of the metal body (170) and with a height equal to the second layer (174).

This bottom guide set (169) eliminates the need of making a notch in one of the two sliding strips inserted in the bottom track, making this support area completely flat and continuous. This way the base of the bottom profile (5) won't hit or get stuck in the sliding strips during the pivoting movement, making the operation of the system smoother. Another improvement is that the possibility of damaging the strips, while folding the panes, is removed.

Figure 56:
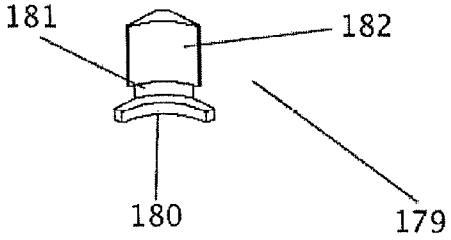
FIGS. 56 and 57: Curved wedge side elevation and side view
Figure 57:
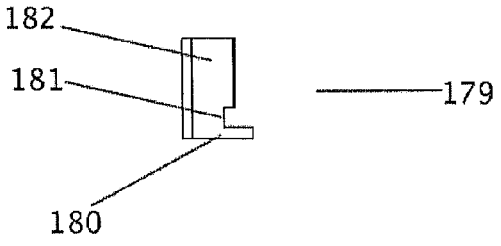

Thirteenth addition, wherein a wedge (179) has three layers with a rounded side. As depicted in FIGS. 56 and 57, first layer (180) is a base placed underneath the two-par adjustable corner plate (145). It has that rounded side to allow the plates (146, 147) to move while connecting two tracks, and at the same time keep the wedge (179) at a fix position when the panes (1) pass along the corner. The second layer (181) connects the first (180) and third one (182) and fills the gap in between the corner and the rounded plates (146, 147) when connecting two sections with angles. The third layer (182) has a rounded shape to avoid the bottom turning (76) bushing (109) to get stuck in the corner and pass along the tracks (7) smoothly from one section to another.

The rounded side wedge (179) is made in one piece by injection to ensure having the right measurements for a perfect coupling with the two-part adjustable corner plate (145) and the bottom track (7) and eliminating possible differences in measurements in different production batches.

The parts of the windbreak system follow this numbering:

1. Pane (1)
2. Glass (2)
3. Trapezoidal aluminum top profile (3) of the pane (1).
4. Trapezoidal aluminum bottom profile (4) of the pane (1).
5. "H" shape bottom sliding profile (5).
6. Top track (6).
7. Bottom track (7).
8. Strips made of a homogeneous mixture of polymer (8).
9. "T" axis guide (9).
10. Top bushing guide (10).
11. Steel plate (11)
12. Bottom steel plate (12).
13. Bottom "T" axis guide (13).
14. Bottom bushing guide (14).
15. Top and bottom turning mechanism (15).
16. Spoon-shaped areas or halfmoons (16).
17. Turning mechanism base (17).
18. Top guide bushing (18).
19. Bottom guide "H" washer.
20. Semicircular hole (20) located at one end of the steel plate (11, 12).
21. Steel plate (11,12) threaded holes (21).
22. Sliding door bottom bushing (22) with five layers and similar to the bottom bushing (14).
23. Guide-arm (23) made of stainless steel.
24. Door (24).
25. Door top cubic pivot (25) made of polyamide.
26. Door top axis screw (26).
27. Door bottom cubic pivot (27) made of polyamide.
28. Door bottom axis screw (28).
29. Screws (29) to fix cubic pivots (25, 27) to the ceiling and floor.
30. Bottom guide screw (30) crossing the top guide bushing (18) and fits into a threaded hole in the steel plate (11).
31. Sliding door bottom plate (31).
32. Semicircular notch (32) at one end of the sliding door bottom plate (31).
33. Opening (33).
34. "T" axis head (34).
35. Bottom lock (35) of the door (24).
36. Top aluminum profile (3) side arms (36).
37. Side arms (36) protuberances (37).
38. Flat base (38) in top aluminum profile (3) of pane (1).
39. Top aluminum profile (3) hole (39).

40. "H" shape bottom aluminum profile (4) side arms (40).
41. Side arms (40) protuberances (42).
42. Rectangular hole (42) in the half opened bottom profile (4) of pane (1).
43. Straight side arms (43) covering the side arms (40). Side arms (43) are part of the bottom sliding profile (5).
44. Flat base (44) in bottom sliding profile (5).
45. Hole (45) in profile (5) where steel plate (12) is placed.
46. Exterior sides (46) in the base of bottom profile (5).
47. Track side (47) with exterior and interior flat face in top (6) and bottom track (7).
48. Track side (48) with exterior flat face and interior with protuberances (49) in top (6) and bottom track (7).
49. Protuberances (49) on interior track side (48).
50. Screws or bolts (50) to fix the top (6) and bottom track (7) to the ceiling and floor.
51. Longitudinal channel (51) in top (6) and bottom track (7).
52. Longitudinal channel (52) in top exterior side (57) close to side (47).
53. Longitudinal cannel (53) in top exterior side (57) close to hole (56).
54. Longitudinal channel (54) in top of exterior side (57) in side wall (48).
55. Wind and water protecting brushes (55).
56. Opening (56) of top (6) and bottom track (7).
57. Exterior side (57) of top (6) and bottom track (7).
58. Guide-arm (23) hole (58).
59. Door (24) locking mechanism (59).
60. Rod (60) of up and down mechanism for the pin (56).
61. Spring (61) of up and down mechanism for the pin (56).
62. Guide-arm (23) flat side, parallel to the floor and containing two holes (57,58).
63. Guide-arm perpendicular flat side (63).
64. Horizontal stepped side (64) for fixing through 3 holes (66).
65. Vertical stepped side (65) for fixing through 3 holes (66).
66. Fixing holes (66) on top of interior side of top track (6).
67. Long hole (67) of the sliding door plate (31).
68. Circular hole (68) of the sliding door plate (31).
69. Door (24) locking mechanism (59) fixing hole (69).
70. Steel plate (70) for fixing the door (24) locking mechanism (5).
71. Top profile (71).
72. Bottom profile (72).
73. "U" shaped leveling profile (73).
74. Leveling sets (74)
75. Top turning set (75).
76. Bottom turning set (76)
77. Top guide set (77).
78. Cap (78)
79. Locking block (79).
80. Pivot block (80).
81. Turning mechanism (81)
82. Internal face of the side arms (82) of the profile (71)
83. Flat base (83) of the profile (71)
84. Small protuberances (84) of the profile (71)
85. Cavity (85) of the profile (71)
86. Flat sides (86) of the profile (71)
87. "U" shape hole (87) of the profile (71)
88. The side arms (88) of the profile (72)
89. Flat base (89) of the profile (72)
90. Small protuberances (90) of the profile (72)
91. Inverted "U" shape hole (91) of the profile (72)
92. Sides (92) of the "U" shaped leveling profile (73).
93. Holes (93) of the profile (73).
94. Eccentric bolt (94)
95. Flat head screw (95).
96. Head (96) of the Flat head screw (95).
97. Metallic body (97) of the top turning set (75).
98. Guide bushing (98) of the top turning set (75).
99. Base (99) of the metallic body (97) which includes three layers (100, 101, 102) plus a protuberance (103).
100. First layer (100) of the metal body (99)
101. Second layer (101) of the metal body (99)
102. Third layer (102) of the metal body (99)
103. Protuberance (103) of the first body (99).
104. Reference mark (104) of the first layer (100)
105. Protuberances (105) of the second layer (101)
106. Axis (106) of the set (75)
107. Metal body (107) of the bottom turning set (76)
108. Metal part (108) with an oval shape and straight sides of the bottom turning set (76)
109. Guide bushing (109) of the bottom turning set (76)
110. Click locking joint (110) bottom turning set (76)
111. First layer (111) bottom turning set (76)
112. Second layer (112) bottom turning set (76).
113. Third layer (113) bottom turning set (76)
114. Reference mark (114) of bottom turning set (76)
115. Small protuberances (115) of the second layer of the bottom turning set
116. The protuberance (116) of the first layer (111) bottom turning set (76)
117. Top guide bushing (117)
118. Metal body (118) of the top guide set (77)
119. Plate (119) of the top guide set (77).
120. First layer (120) of the top guide set (77)
121. Second layer (121) of the top guide set (77)
122. Protuberances (122) of the top guide set (77).
123. Slope (123) of the top guide set (77)
124. The protuberance (124) of the first layer (120) of the top guide set (77)
125. Axis (125) of the top guide set (77)
126. Bottom side (126) of the Cap (78).
127. Vertical side (127) of the Cap (78).
128. Vertical side (128) of the Cap (78).
129. Top side (129) of the Cap (78).
130. Protuberance (130) of the locking block (79).
131. Another protuberance (131) of the locking block (79).
132. Hole (132) of the locking block (79).
133. Hole (133) of the locking block (79).
134. Protuberance (134) of the pivot block (80)
135. Pole (135) of the pivot block (80).
136. Protuberance of the pivot block (80).
137. Hole (137) of the turning mechanism (81).
138. Hole (138) of the pivot block (80).
139. Recess (139) of the sides of the pivot block (80)
140. Spoon-shaped areas (140) of the turning mechanism (81)
141. Hole (141) of the turning mechanism (81)
142. Hole (142) of the turning mechanism (81)
143. Side (143) of the pivot block (80)
144. Side (144) of the pivot block (80)
145. Corner plate (145)
146. Plate (146) of the corner plate (145).
147. Plate (147) of the corner plate (145).
148. Joint section (148) for the plate (146, 147) of the corner plate (145).
149. Straight edge (149) of the corner plate (145).
150. Straight edge (150) of the corner plate (145).
151. Small side (151) of the corner plate (145).
152. Small side (152) of the corner plate (145).
153. Oval hole (153) of the corner plate (145).
154. Hole (154) of the corner plate (145).
155. Circular hole (155) of the corner plate (145).
156. Second circular hole (156) of the corner plate (145).

157. Recess (157) of the plate (146).
158. Recess (158) of the plate (147).
159. Metal axis element (159).
160. Bushing (160)
161. Bottom area (161) of the metal axis element (159).
162. Wings (162) of the metal axis element (159).
163. Head (163) of the metal axis element (159).
164. Front side (164) of the metal axis element (159).
165. Semicircular faces (165) of the bushing (160).
166. Second layer (167) of the bushing (160).
167. Ramp (167) of the second layer (167).
168. Inner hole (168) of the bushing (160).
169. Bottom guide (169).
170. Metal plate (170) of the bottom guide (169)
171. Washer (171) of the bottom guide (169).
172. Channel (172) of the metal plate (170).
173. First layer (173) of the metal body (170) of the bottom guide (169).
174. Second layer (174) of the metal body (170) of the bottom guide (169)
175. Protuberances (175) of the first layer (173) of the metal plate (170).
176. Base (176) of the washer (171).
177. Head (177) of the Washer (171).
178. Interior hole (178) of the bottom guide (169).
179. Wedges (179)
180. First layer (180) of the wedge (179).
181. Second layer (181) of the wedge (179).
182. Third layer of the wedge (179).

INDUSTRIAL APPLICATION

This invention has an industrial application in the technical sector of construction mobile structures.

The invention claimed is:

1. A windbreak system comprising:

a set of foldable and independent panes sliding in a longitudinal way along a top track and a bottom track, and a foldable and non-sliding door with a pivot axis, wherein the panes and the door have a pivot and folding axis and comprise at least a top profile and a bottom profile, where the top profile and the bottom profile are selected among the following profiles:

a first aluminum H-shaped profile comprising:

a flat base two top side arms with internal faces comprising protuberances up to 0.5 millimeters long, wherein both top side arms have a cavity and ends of the two top side arms form two flat sides opposite to each, and two bottom side arms delimiting an inverted "U" hole partially opened, wherein the flat base comprises the opposite side to the opening of the "U" hole;

a second aluminum H-shaped profile comprising:

a flat base, two top side arms with internal faces comprising protuberances up to 0.5 mm long, and two bottom side arms delimiting an inverted "U" hole partially opened, wherein the flat base comprises the opposite side to the opening of the "U" hole;

wherein the panes and the door have a glass glued to the top side arms of said H-shaped profiles and each pane comprises a bottom sliding H-shaped profile, comprising:

two straight arms curved at its ends, and a base, and two L-shaped arms opposite to the two straight arms, where two adjustable screws are placed to regulate a height of the bottom profile in relation to the base of the bottom sliding H-shaped profile, with the two straight arms covering the bottom side arms of the bottom profile, and the base and the two straight arms form a top hollow section in the bottom sliding H-shaped profile that forms a pane support; and the two L-shaped arms and the base form a bottom hollow section;

wherein a top turning set is inserted and fixed to the inverted "U" hole of the top profile, the bottom track and the top track are identical and comprise a rectangular section and have a side with an opening delimited by two equidistant sides of the rectangular section of the track and a side having a notch channel and positioned opposite to a side in contact with a ceiling or a floor, and the side that comprises the opening has two outer equidistant channels where two strips, one inside each channel are fitted in the bottom track and the two strips are made of a homogeneous mixture of self-lubricating polymer, wherein the top profile is connected at the folding axis to the top track by a top guide set formed by a first metal body and a top guide bushing wherein the first metal body is comprises a first plate with a first layer and a second layer, a cylindrical axis and a protuberance, with said first layer comprising said protuberances, and a downward slope at a front end, and the second layer is as wide as the partially opened inverted "U" hole of the top profile, and the top guide bushing has a circular shape and is a one piece element made of polyamide, said top guide bushing is inserted by pressure into the cylindrical axis of the first metal body and has an outer diameter as wide as the opening of the top track, and wherein the bottom sliding H-shaped profile is connected, at the folding axis, to the bottom track by a bottom guide set formed by a second metal body and a washer made of polyamide, said second metal body comprises a base and a cylindrical interior hole, said base is a second plate with a first layer and a second layer, the first layer comprises protuberances, up to 0, 5 mm long, and a channel located at an opposite side of the first layer being as wide as the opening of the a bottom sliding H-shaped profile, wherein and the height of the second layer is the same as the thickness of the base of the bottom sliding H-shaped profile, the washer is made of polyamide and has a round shape and a hole along a vertical axis, the washer comprises a head and a base layer, wherein the diameter of the base is greater than the diameter of the head, said polyamide washer is inserted by pressure through the cylindrical interior hole of the second metal body.

2. The windbreak system comprising a set of independent panes and a door according to claim 1, wherein the bottom track and the top track comprise one flat inside wall and another vertical wall that has a set of protuberances forming a virtual wall equidistant from the vertical wall, and the side comprising the opening with equidistant channels where brushes are placed in the top track comprises a third channel having drills.

3. The windbreak system comprising a set of independent panes and a door according to claim 2, comprising a H-shaped washer made of polyamide having a top cylindrical side and a bottom cylindrical side joined by an axis, the top cylindrical side is fitted inside the bottom hollow section of the bottom sliding H-shaped profile and the axis is placed between the two L-shaped arms of the bottom sliding H-shaped profile in such a way that the bottom side of the washer is not resting on the bottom track.

4. The windbreak system comprising a set of independent panes and a door according to claim 3, wherein the panes leave the top track through a single hole with a diameter one centimeter bigger than the diameter of the top guide bushing, a stainless steel guide-arm that stands out of said single hole perpendicularly to the top track, the stainless steel guide-arm comprising a flat side including two holes parallel to a floor, wherein said flat side stands out perpendicularly to the top track, another side that is perpendicular to the top track and to the flat side, and a step side comprising three holes fixed, by means of three screws placed in the three holes, to the top track.

5. The windbreak system comprising a set of independent panes and a door according to claim 1 wherein the bottom track is hold in a "U" shaped levelling profile resting on levelling sets formed by a flat head screw and an eccentric bolt with dimensions selected to fit with the dimensions in the "U" shaped levelling profile so that the leveling sets completely rest on a base of the "U" shaped levelling profile, wherein two corner holes are provided to insert a cap that is placed at ends of the bottom track, said cap having the same shape as the section of bottom track, wherein a bottom side is flat and a top side is narrows, one vertical side is flat and the opposite vertical side has a contour with protuberances complementary to the protuberances of the bottom track.

6. The windbreak system comprising a set of independent panes and a door according to claim 5, wherein the pivot axis of each pane is formed by:

a second top turning set having a second metal body and a second top guide bushing, the second metal body comprises a base plate with a first layer, a second layer, a third layer and a wedge shaped protuberance, wherein the first layer has a reference mark; the second layer contains small protuberances, up to 0.5 mm long, and the third layer is as wide as the partially opened inverted "U" hole of the top profile, the second top guide bushing has a circular shape and two layers, wherein the bushing is inserted by pressure into a rounded axis metal head of the second top turning set, a bottom turning set having a bottom guide bushing, a metal plate and another metal part having an oval shape and straight sides, said metal plate and said another metal part are assembled by a square click locking joint, a base of the metal body is a plate with three layers and a protuberance, wherein a reference mark is provided in a first layer, a second layer has small protuberances on its surface and a third layer has the same width as the width of a bottom sliding profile opening between the L-shaped sides, the protuberance of the metal body base has a wedge shape and the bottom guide bushing has a "T" shape comprising flat side faces and rounded front and rear side faces, wherein the bottom guide bushing is narrower than the bottom track opening and is centered, but not fixed, in relation to the pivot axis, a pivot block having a rectangular shape comprising external flat sides and other two sides comprising a hole and a tab, and a hole off centered where the door is inserted, a turning mechanism having taps and holes configured to with the taps and holes of the pivot block for assembling the turning mechanism with the pivot block, two additional holes, wherein one of said two additional holes is closer to the pivot block and has a diameter greater than the diameter of said other additional hole, and two spoon-shaped areas.

7. The windbreak system comprising a set of independent panes and a door according to claim 6, wherein the panes and the door pivot by means of a mechanism formed by a metal axis element and a blocking bushing wherein:

the metal axis element has a cylindrical shape with three different areas: a bottom area that has a semi-circular shape, a middle area having two wings connected with an element having the shape of a ramp, and a top area having a head with a small ramp in a base, wherein a front side of the head has a rounded shape and is configured to block the pane when folded, so that as the metal axis element is blocked by the semicircular shape of the bottom area when said metal axis rotates approximately 90° in relation to the blocking bushing, the blocking bushing has a circular shape with a central hole and two layers, providing the hole as an oval shape with straight arms grasping the metal axis, a first layer of said two layers has a ramp, and a second layer of said two layers is symmetric to a central vertical axis and has an interior ramp in a inner hole, and two rounded sides that block the metal axis element.

8. The windbreak system comprising a set of independent panes and a door according to claim 7, wherein a door locking system includes a one-piece top locking block having a rectangular parallelepiped shape with two protuberances and a short semi-circular side, the locking block also has two holes having different diameters, wherein a protuberance of said two protuberances is aimed to position said locking block perpendicular to the top profile of the door, and another protuberance of said two protuberances is positioned in a front side that works as a stopper against an interior side of said top profile.

9. The windbreak system comprising a set of independent panes and a door according to claim 8, wherein sections of the tracks that are not linear include a two-part adjustable corner plate having two identical plates, each plate comprising two small sides: a rounded shape side and a straight side, and two long sides, wherein the two identical plates are connected by a joint section in the rounded shape sides of the plates and having a step delimited by two straight edges forming an interior angle of 270°, wherein along a central axis of each of the plates there is an oval hole with a longer axis parallel to the long sides of the plate, and a circular hole, the oval holes being closer to the small straight side of the plates, and a wedge having three layers: a first layer is a base placed underneath the two-part adjustable corner plate, a second layer is smaller and narrower than the other two layers and a third layer has a rounded shape.

10. The windbreak system comprising a set of independent panes and a door according to claim 9, wherein the top turning guide metal body, the metal plate and the another metal part in the bottom turning set, the caps, the locking block, the turning mechanism and the pivot block, the two-part adjustable corner plate, the metal axis element and the blocking bushing, the plate in the bottom guide and the wedges are made as a single piece by injection using aluminum, stainless steel or other metal alloys.

11. The windbreak system comprising a set of independent panes and a door according to claim 10, wherein each pane and door has a tempered glass sheet with a thickness within a range of 6 to 20 millimeters and the maximum pane height is about 3.5 meters.

12. The windbreak system comprising a set of independent panes and a door according to claim 10, wherein the pivoting and sliding movement of every pane and door is done manually and without any bearings.

13. The windbreak system comprising a set of independent panes and a door according to claim 10, wherein a transparent rigid plastic strip is placed by pressure between two panes and fitted in the glass edge without any fixation element.

14. The windbreak system comprising a set of independent panes and a door according to claim 10, wherein an adhesive brush is placed in the edges of the glasses to cover the hole in between two consecutive panes.

* * * * *